US006475689B2

(12) United States Patent
Yamazaki et al.

(10) Patent No.: US 6,475,689 B2
(45) Date of Patent: Nov. 5, 2002

(54) TONER FOR DEVELOPING ELECTROSTATIC LATENT IMAGE

(75) Inventors: Hiroshi Yamazaki, Hachioji (JP); Kenji Yamane, Hachioji (JP); Hiroyuki Kozuru, Hachioji (JP); Kenji Hayashi, Hino (JP); Mikio Kohyama, Hino (JP)

(73) Assignee: Konica Corporation (JP)

( * ) Notice: Subject to any disclaimer, the term of this patent is extended or adjusted under 35 U.S.C. 154(b) by 0 days.

(21) Appl. No.: 09/907,243

(22) Filed: Jul. 17, 2001

(65) Prior Publication Data

US 2002/0034703 A1 Mar. 21, 2002

(30) Foreign Application Priority Data

Jul. 19, 2000 (JP) ..... 2000-218980

(51) Int. Cl.[7] ..... G03G 9/087
(52) U.S. Cl. ..... 430/108.4; 430/110.3
(58) Field of Search ..... 430/69, 96, 108.4, 430/110.3

(56) References Cited

U.S. PATENT DOCUMENTS 5,521,268 A * 5/1996 Ghyzel et al. ..... 526/224
5,541,031 A * 7/1996 Yamashita et al. ..... 430/109

* cited by examiner

*Primary Examiner*—John Goodrow
(74) *Attorney, Agent, or Firm*—Bierman, Muserlian and Lucas

(57) ABSTRACT

A toner for developing electrostatic latent image is disclosed. The toner comprise of particles having a volume average particle diameter of from 3 to 8 $\mu$m, and said resin is obtained by either emulsion polymerization, mini-emulsion polymerization employing or suspension polymerization employing thioglycerin or at least one compound selected from compounds represented by the Formula (1) as the chain transfer agent.

$$HS—R_1—COOR_2 \quad (1)$$

In the formula, $R_1$ is an aliphatic group having carbon atoms from 1 to 10, which may have a substituent, and $R_2$ is an aliphatic group having carbon atoms from 1 to 15, which may have a substituent.

19 Claims, 8 Drawing Sheets

TONER FOR DEVELOPING ELECTROSTATIC LATENT IMAGE

FIELD OF THE INVENTION

The present invention relates to a toner for developing electrostatic latent images, employed in printers, copiers facsimile machines, and the like, and to an image forming method using the same.

BACKGROUND OF THE INVENTION

At present, a method for developing electrostatic latent images, represented by electrophotography, is widely applied to image forming methods which are employed in printers, copiers, facsimile machines, and the like.

This reason is due to the fact that said method is highly completed so that high quality images are consistently obtained at a high speed. However, several problems still remain to be solved. One of said problems is that from the viewpoint of consistent toner fixation, it is necessary to control the molecular weight distribution of toner resins. For example, in order to minimize offsetting at a relatively high temperature, it is necessary to enhance the elastic modulus at said temperature. Therefore, it is preferable to increase high molecular weight components. On the other hand, in order to improve adhesion properties to image forming supports such as paper and the like, it is preferable to increase low molecular weight components. In order to satisfy such contradicting functions, it has been required that the molecular weight distribution is broadened.

On the other hand, from the viewpoint of high image quality, the diameter of toner particles for developing electrostatic latent images is decreased, and further, the particle diameter is desired to be uniform. As methods for producing such toner particle with small diameter, in recent years, development of polymerization methods for producing such a toner has been increasingly performed. Said polymerization methods include a method in which resin particles and colorant particles are subjected to coalescence or salting-out/fusion to prepare irregular-shaped toner particles, a method in which radical polymerizable monomers and colorants are dispersed, followed by being subjected to droplet dispersion into water based medium and the like to obtain the desired diameter of toner particles, and the resultant dispersion undergoes suspension polymerization, and the like.

As noted above, it is necessary that the molecular weight distribution of all resins be regulated to enhance fixability. In order to control the molecular weight distribution, when the molecular weight is decreased utilizing chain transfer agents, employed as suitable chain transfer agents are mercaptan based compounds, especially dodecylmercaptan. However, said components emit specific odor. Accordingly, during heat fixing, residual chain transfer agents volatile to cause a problem of bad smell generation.

Further adhesion property of the toner is not enough and induces disadvantages such as lowering of fixing efficiency and deterioration of off set, and causes image defect such as fogging by variation of charging for use in long period when dodecylmercaptan chain transfer agents are employed.

SUMMARY OF THE INVENTION

Said bad smell problem has not been particularly concerned when the so-called pulverization method toner is used, which is prepared by pulverizing block-shaped mixture which is obtained by melt-kneading synthesized resins and colorants followed by cooling the resulting mixture. The inventors of the present invention investigated said problem and discovered that when said polymerization method toner, in which small toner particles were directly prepared, was used, said bad smell caused a problem during image formation.

An object of the present invention is to provide a toner for developing electrostatic latent images, which is prepared employing a polymerization method, is comprised of particles with small diameter, minimizes the generation of a bad smell, causes no bad smell problem and exhibits excellent fixability, and to provide an image forming method using the same.

The other object is to provide a toner for developing electrostatic latent images, which exhibits stabilized charging characteristics and reduced off set phenomenon for long term use.

The object of the present invention is achieved employing the following.

1. In a toner for developing electrostatic latent images, which is comprised of at least a resin and a colorant, a toner for developing electrostatic latent images wherein said toner is comprised of particles having a volume average particle diameter of from 3 to 8 $\mu$m, and said resin is obtained by either emulsion polymerization or mini-emulsion polymerization employing as the chain transfer agent thioglycerin or at least one compound selected from compounds represented by the General Formula (1).

$$HS—R_1—COOR_2 \quad (1)$$

In the formula, $R_1$ is an aliphatic group having carbon atoms from 1 to 10, which may have a substituent, and $R_2$ is an aliphatic group having carbon atoms from 2 to 15, which may have a substituent.

2. In a toner for developing electrostatic latent images, which is comprised of at least a resin and a colorant, a toner for developing electrostatic latent images wherein said toner is comprised of particles having a volume average particle diameter of from 3 to 8 $\mu$m, and said resin is obtained by a suspension polymerization method employing radical polymerizable monomers, as well as thioglycerin or at least one compound selected from compounds represented by the aforementioned General Formula (1), as the chain transfer agent.
3. In an image forming method in which a toner image on an image support, which is formed employing a toner comprised of at least a resin and a colorant, is subjected to heat fixing, an image forming method wherein said toner is comprised of particles having a volume average particle diameter of from 3 to 8 $\mu$m, and said resin is obtained by either emulsion polymerization or mini-emulsion polymerization employing as the chain transfer agent thioglycerin or at least one compound selected from compounds represented by the aforementioned General Formula (1).
4. In an image forming method in which a toner image on an image support, which is formed employing a toner comprised of at least a resin and a colorant, is subjected to heat fixing, an image forming method wherein said toner is comprised of particles having a volume average particle diameter of from 3 to 8 $\mu$m, and said resin is obtained by a suspension polymerization method, employing radical polymerizable monomers, as well as thioglycerin or at least one compound selected from compounds represented by the aforementioned General Formula (1), as the chain transfer agent.

DETAILED DESCRIPTION OF THE INVENTION

Figure 1:
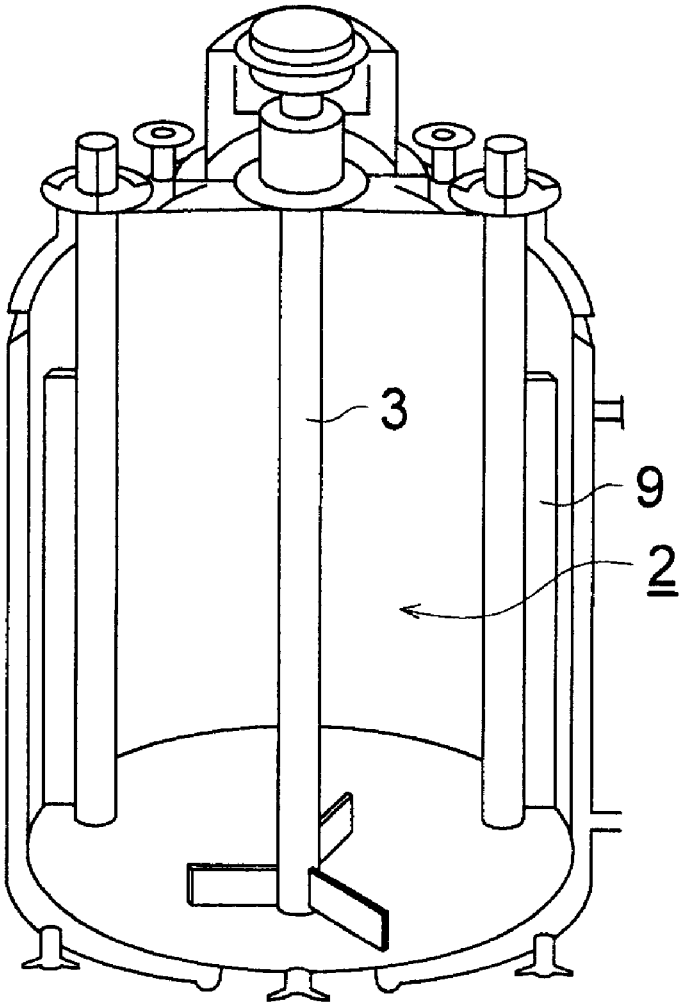
FIG. 1 is a perspective view of one example of a stirring tank equipped with conventional stirring blades.

The inventors of the present invention investigated basic differences between the kneading method and the polymerization method and were able to accomplish the present invention.

The so-called pulverization method toner is prepared by melt-kneading resins and colorants, thereafter pulverizing the resultant mixture, and subsequently, classifying pulverized particles. In said process, great shear is applied to said toner through heating resins at a higher temperature than the melting temperature as well as the use of kneading devices such as biaxial extruders, and the like. Due to that, since said resins are heated at a higher temperature than the softening point, chain transfer agents in said resins are vaporized due to applied heat. As a result, it is almost impossible for said chain transfer agents to remain in the finished toner as they are.

On the other hand, the so-called polymerization method toner is not subjected to said melt-kneading process as described above. When said toner is prepared employing a radical polymerization method, heating is limited to about 100° C. which is the boiling point of water. As a result, it was assumed that a minute amount of said chain transfer agents remained and said bad smell problem occurred due to their vaporization at the temperature during fixing.

In order to overcome said problem, it has been discovered that in the polymerization method toner, compounds represented by Formula Formula (1) are effectively employed.

Listed as preferred compounds represented by the aforementioned General Formula (1) may be thioglycolic acid esters and 3-mercaptopropionic acid esters. Preferably 3-mercaptopropionic acid esters are employed.

Listed as specific examples may be thioglycolic acid esters such as ethyl thioglycolate, butyl thioglycolate, t-butyl thioglycolate, 2-ethylhexyl thioglycolate, octyl thioglycolate, isooctyl thioglycolate, decyl thioglycolate, dodecyl thioglycolate, thioglycolic acid ester of ethylene glycol, thioglycolic acid ester of neopentylglycol, thioglycolic acid ester of trimethylolpropane, thioglycolic acid esters of pentaerythritol, and thioglycolic acid ester of sorbitol; and 3-mercaptopropionic acid esters such as ethyl 3-mercaptopropionate, 2-ethlhexyl 3-mercaptopropionate, octyl 3-mercaptopropionate, decyl 3-mercaptopropionate, dodecyl 3-mercaptopropionate, pentaerythritoltetrakis 3-mercaptopropionate, 3-mercaptoprpionic acid ester of ethylene glycol, 3-mercaptoprpionic acid ester of neopentyl glycol, 3-mercaptoprpionic acid ester of trimethylolpropane, 3-mercaptoprpionic acid ester of pentaerythritol, and 3-mercaptoprpionic acid ester of sorbitol.

The used amount is suitably from 0.01 to 5 percent by weight with respect the total monomers employed for the synthesis of said resins.

Polymers contain the chain transfer agent at the end of the polymer, in other words, the surface of the resin particle has different property from the center of the particle. Resin particles having said surface property causes deteriorated effect on toner characteristics such as image forming control. Thioglycerin or the chain transfer agent represented by the Formula (1) can minimize the deterioration.

Further, finished resins are preferably comprised of both high molecular weight components having a peak or shoulder in the molecular weight range of from 100,000 to 1,000,000 and low molecular weight components having a peak or shoulder in the molecular weight range of from 1,000 to 20,000.

Further, the molecular weight of said resins is determined utilizing a GCP (gel permeation chromatography) in which THF is used as the solvent. The weight of the sample generally ranges from 0.5 to 5 mg. More specially, 1 mg of the sample is added to 1 ml of THF, and is completely dissolved at room temperature, utilizing a magnetic stirrer and the like. Subsequently, after treating the resulting solution, employing a membrane filter having a pore size of from 0.45 to 0.50 $\mu$m, the resulting solution is injected into said GCP. Measurement is carried out under conditions that the column is stabilized at 40° C., THF flows at a rate of 1 ml per minute, and about 100 $\mu$l of the sample at a concentration of 1 mg/ml is injected. Columns are preferably employed in combinations of commercially available polystyrene columns. It is possible to cite combinations of Shodex GCP KF-801, 802, 803, 804, 805, 806, and 807, manufactured by Showa Denko Co., Ltd. and combinations of TSKgel G1000H, G2000H, G3000H, G4000H, G5000H, G6000H, G7000H, TSK guard column, manufactured by Tosoh Corp., and the like. Further, preferably employed as detectors are refractive index detectors (IR detectors) or UV detectors. The molecular weight of each sample is calculated utilizing a calibration curve in which the molecular weight distribution of said sample is prepared employing standard monodispersed polystyrene particles. It is preferable that said calibration curve is dawn connecting tens points obtained by said standard polystyrene particles.

Toner particles comprises a colorant and a resin, and optionally other additives such as releasing agent and a charge control agent. It is possible to prepare the toner of the present invention in such a manner that fine polymerized particles are produced employing a suspension polymerizing, an emulsion polymerization or a mini-emulsion polymerization. In these polymerization chain transfer agent is employed.

Since smaller particles than those necessary to employ by themselves are obtained by the emulsion polymerization or mini-emulsion polymerization, the smaller particles are gathered to form particles having size for toner particles by association.

In the emulsion polymerization or mini-emulsion polymerization method the colorant and additives, if necessary, may be incorporated in resin particles during polymerization process or association process. The monomers are polymerized in a liquid added with the colorant and the necessary additives, and thereafter, association is carried out by adding organic solvents, coagulants, and the like, in the former way. In the latter way polymerized resin particles are subjected to associating upon mixing dispersions of the additives and the colorant and the additives are included in toner particles. Association as described herein means that a plurality of resin particles and colorant particles are fused.

In the suspension polymerization process, added to the polymerizable monomers are colorants, and if desired, releasing agent, charge control agents, and further, various types of components such as polymerization initiators, and in addition, various components are dissolved in or dispersed into the polymerizable monomers employing a homogenizer, a sand mill, a sand grinder, an ultrasonic homogenizer, and the like. The polymerizable monomers in which various components have been dissolved or dispersed are dispersed into a water based medium to obtain oil droplets having the desired size of a toner, employing a homomixer, a homogenizer, and the like. Thereafter, the resultant dispersion is conveyed to a reaction apparatus which utilizes stirring blades described below as the stirring mechanism and undergoes polymerization reaction upon heating. After completing the reaction, the dispersion stabilizers are removed, filtered, washed, and subsequently dried. In this manner, the toner of the present invention is prepared.

In the emulsion polymerization or mini-emulsion polymerization method for preparing said toner, wherein the resin particles are associated or fused, in a water based medium, exemplary methods are described in Japanese Patent Publication Open to Public Inspection Nos. 5-265252, 6-329947, and 9-15904.

The water based medium means one in which at least 50 percent, by weight of water, is incorporated.

It is possible to form the toner of the present invention by employing a method in which at least two of the dispersion particles of components such as resin particles, colorants, and the like, or fine particles, comprised of resins, colorants, and the like, are associated, specifically in such a manner that after dispersing these in water employing emulsifying agents, the resultant dispersion is salted out by adding coagulants having a concentration of at least the critical coagulating concentration, and simultaneously the formed polymer itself is heat-fused at a temperature higher than the glass transition temperature, and then while forming said fused particles, the particle diameter is allowed gradually to grow; when the particle diameter reaches the desired value, particle growth is stopped by adding a relatively large amount of water; the resultant particle surface is smoothed while being further heated and stirred, to control the shape and the resultant particles which incorporate water, is again heated and dried in a fluid state. Further, herein, organic solvents, which are infinitely soluble in water, may be simultaneously added together with said coagulants.

Those which are employed as polymerizable monomers to constitute resins include styrene and derivatives thereof such as styrene, o-methylstyrene, m-methylstyrene, p-methylstyrene, α-methylstyrene, p-chlorostyrene, 3,4-dichlorostyrene, p-phenylstyrene, p-ethylstryene, 2,4-dimethylstyrene, p-tert-butylstyrene, p-n-hexylstyrene, p-n-octylstyrene, p-n-nonylstyrene, p-n-decylstyrene, p-n-dodecylstyrene; methacrylic acid ester derivatives such as methyl methacrylate, ethyl methacrylate, n-butyl methacrylate, isopropyl methacrylate, isobutyl methacrylate, t-butyl methacrylate, n-octyl methacrylate, 2-ethyl methacrylate, stearyl methacrylate, lauryl methacrylate, phenyl methacrylate, diethylaminoethyl methacrylate, dimethylaminoethyl methacrylate; acrylic acid esters and derivatives thereof such as methyl acrylate, ethyl acrylate, isopropyl acrylate, n-butyl acrylate, t-butylacrylate, isobutyl acrylate, n-octyl acrylate, 2-ethylhexyl acrylate, stearyl acrylate, lauryl acrylate, phenyl acrylate, and the like; olefins such as ethylene, propylene, isobutylene, and the like; halogen based vinyls such as vinyl chloride, vinylidene chloride, vinyl bromide, vinyl fluoride, vinylidene fluoride, and the like; vinyl esters such as vinyl propionate, vinyl acetate, vinyl benzoate, and the like; vinyl ethers such as vinyl methyl ether, vinyl ethyl ether, and the like; vinyl ketones such as vinyl methyl ketone, vinyl ethyl ketone, vinyl hexyl ketone, and the like; N-vinyl compounds such as N-vinylcarbazole, N-vinylindole, N-vinylpyrrolidone, and the like; vinyl compounds such as vinylnaphthalene, vinylpyridine, and the like; as well as derivatives of acrylic acid or methacrylic acid such as acrylonitrile, methacrylonitrile, acryl amide, and the like. These vinyl based monomers may be employed individually or in combinations.

Further preferably employed as polymerizable monomers, which constitute said resins, are those having an ionic dissociating group in combination, and include, for instance, those having substituents such as a carboxyl group, a sulfonic acid group, a phosphoric acid group, and the like as the constituting group of the monomers. Specifically listed are acrylic acid, methacrylic acid, maleic acid, itaconic acid, cinnamic acid, fumaric acid, maleic acid monoalkyl ester, itaconic acid monoalkyl ester, styrenesulfonic acid, allylsulfosuccinic acid, 2-acrylamido-2-methylpropanesulfonic acid, acid phosphoxyethyl methacrylate, 3-chloro-2-acid phosphoxyethyl methacrylate, 3-chlor-2-acid phosphoxypropyl methacrylate, and the like.

Further, it is possible to prepare resins having a bridge structure, employing polyfunctional vinyls such as divinylbenzene, ethylene glycol dimethacrylate, ethylene glycol diacrylate, diethylene glycol dimethacrylate, diethylene glycol diacrylate, triethylene glycol dimethacrylate, triethylene glycol diacrylate, neopentyl glycol methacrylate, neopentyl glycol diacrylate, and the like.

It is possible to polymerize these polymerizable monomers employing radical polymerization initiators.

In such a case, it is possible to employ oil-soluble polymerization initiators when a suspension polymerization method is carried out. Listed as these oil-soluble polymerization initiators may be azo based or diazo based polymerization initiators such as 2,2'-azobis-(2,4-dimethylvaleronitrile), 2,2'-azobisisobutyronitrile, 1,1'-azobiscyclohexanone-1-carbonitrile), 2,2'-azobis-4-methoxy-2,4-dimethylvaleronitrile, azobisisobutyronitrile, and the like; peroxide based polymerization initiators such as benzoyl peroxide, methyl ethyl ketone peroxide, diisopropyl peroxycarbonate, cumene hydroperoxide, t-butyl hydroperoxide, di-t-butyl peroxide, dicumyl peroxide, 2,4-dichlorobenzoyl peroxide, lauroyl peroxide, 2,2-bis-(4,4-t-butylperoxycyclohexane)propane, tris-(t-butylperoxy) triazine, and the like; polymer initiators having a peroxide in the side chain; and the like.

Further, when such an emulsion polymerization method or mini-emulsion polymerization is employed, it is possible to use water-soluble radical polymerization initiators. Listed as such water-soluble polymerization initiators may be persulfate salts, such as potassium persulfate, ammonium persulfate, and the like, azobisaminodipropane acetate salts, azobiscyanovaleric acid and salts thereof, hydrogen peroxide, and the like.

In the mini-emulsion polymerization process, oil in water dispersion is prepared by dispersing monomer liquid in which releasing agent, charge controlling agent etc. have been dissolved by employing mechanical energy in water based medium dissolving surfactant with concentration under critical micelle concentration, then a water soluble polymerization initiator is added to the obtained the oil in water dispersion whereby radical polymerization is conducted within the oil droplet. An oil soluble polymerization initiator can be employed in place of all or a part of the water soluble polymerization initiator in this process.

Cited as dispersion stabilizers may be tricalcium phosphate, magnesium phosphate, zinc phosphate, aluminum phosphate, calcium carbonate, magnesium carbonate, calcium hydroxide, magnesium hydroxide, aluminum hydroxide, calcium metasilicate, calcium sulfate, barium sulfate, bentonite, silica, alumina, and the like. Further, as dispersion stabilizers, it is possible to use polyvinyl alcohol, gelatin, methyl cellulose, sodium dodecylbenzene sulfonate, ethylene oxide addition products, and compounds which are commonly employed as surface active agents such as sodium higher alcohol sulfate.

In the present invention, preferred as excellent resins are those having a glass transition point of 20 to 90° C. as well as a softening point of 80 to 220° C. Said glass transition point is measured employing a differential thermal analysis method, while said softening point can be measured employing an elevated type flow tester. Preferred as these resins are those having a number average molecular weight (Mn) of 1,000 to 100,000, and a weight average molecular weight (Mw) of 2,000 to 100,000, which can be measured employing gel permeation chromatography. Further preferred as resins are those having a molecular weight distribution of Mw/Mn of 1.5 to 100, and is most preferably between 1.8 and 70.

Employed coagulants are not particularly limited, but those selected from metal salts are more suitable. Specifically, listed as univalent metal salts are salts of alkaline metals such as, for example, sodium, potassium, lithium, and the like; listed as bivalent metal salts are salts of alkali earth metals such as, for example, calcium, magnesium, and salts of manganese, copper, and the like; and listed as trivalent metal salts are salts of iron, aluminum, and the like. Listed as specific salts may be sodium chloride, potassium chloride, lithium chloride, calcium chloride, zinc chloride, copper sulfate, magnesium sulfate, manganese sulfate, and the like. These may also be employed in combination.

These coagulants are preferably added in an amount higher than the critical coagulation concentration. The critical coagulation concentration as described herein means an index regarding the stability of water based dispersion and concentration at which coagulation occurs through the addition of coagulants. Said critical coagulation concentration markedly varies depending on emulsified components as well as the dispersing agents themselves. Said critical coagulation concentration is described in, for example, Seizo Okamura, et al., "Kobunshi Kagaku (Polymer Chemistry) 17", 601 (1960) edited by Kobunshi Gakkai, and others. Based on said publication, it is possible to obtain detailed critical coagulation concentration. Further, as another method, a specified salt is added to a targeted particle dispersion while varying the concentration of said salt; the ξ potential of the resultant dispersion is measured, and the critical coagulation concentration is also obtained as the concentration at which said ξ potential varies.

The acceptable amount of the coagulating agents of the present invention is an amount of more than the critical coagulation concentration. However, said added amount is preferably at least 1.2 times as much as the critical coagulation concentration, and is more preferably 1.5 times.

The solvents, which are infinitely soluble as described herein, mean those which are infinitely soluble in water, and in the present invention, such solvents are selected which do not dissolve the formed resins. Specifically, listed may be alcohols such as methanol, ethanol, propanol, isopropanol, t-butanol, methoxyethanol, butoxyethanol, and the like. Ethanol, propanol, and isopropanol are particularly preferred.

The added amount of infinitely soluble solvents is preferably between 1 and 100 percent by volume with respect to the polymer containing dispersion to which coagulants are added.

Incidentally, in order to make the shape of particles uniform, it is preferable that colored particles are prepared, and after filtration, the resultant slurry, containing water in an amount of 10 percent by weight with respect to said particles, is subjected to fluid drying. At that time, those having a polar group in the polymer are particularly preferable. For this reason, it is assumed that since existing water somewhat exhibits swelling effects, the uniform shape particularly tends to be made.

The toner of the present invention is comprised of at least resins and colorants. However, if desired, said toner may be comprised of releasing agents, which are fixability improving agents, charge control agents, and the like. Further, said toner may be one to which external additives, comprised of fine inorganic particles, fine organic particles, and the like, are added.

Employed as colorants, which are used in the present invention, are carbon black, magnetic materials, dyes, pigments, and the like. Employed as carbon blacks are channel black, furnace black, acetylene black, thermal black, lamp black, and the like. Employed as ferromagnetic materials may be ferromagnetic metals such as iron, nickel, cobalt, and the like, alloys comprising these metals, compounds of ferromagnetic metals such as ferrite, magnetite, and the like, alloys which comprise no ferromagnetic metals but exhibit ferromagnetism upon being thermally treated such as, for example, Heusler's alloy such as manganese-copper-aluminum, manganese-copper-tin, and the like, and chromium dioxide, and the like.

Employed as dyes may be C.I. Solvent Red 1, the same 49, the same 52, the same 63, the same 111, the same 122, C.I. Solvent Yellow 19, the same 44, the same 77, the same 79, the same 81, the same 82, the same 93, the same 98, the same 103, the same 104, the same 112, the same 162, C.I. Solvent Blue 25, the same 36, the same 60, the same 70, the same 93, the same 95, and the like, and further mixtures thereof may also be employed. Employed as pigments may be C.I. Pigment Red 5, the same 48:1, the same 53:1, the same 57:1, the same 122, the same 139, the same 144, the same 149, the same 166, the same 177, the same 178, the same 222, C.I. Pigment Orange 31, the same 43, C.I. Pigment Yellow 14, the same 17, the same 93, the same 94, the same 138, C.I. Pigment Green 7, C.I. Pigment Blue 15:3, the same 60, and the like, and mixtures thereof may be employed. The number average primary particle diameter varies widely depending on their types, but is preferably between about 10 and about 200 nm.

Employed as methods for adding colorants may be those in which polymers are colored during the stage in which polymer particles prepared employing the emulsification method are coagulated by addition of coagulants, in which colored particles are prepared in such a manner that during the stage of polymerizing monomers, colorants are added and the resultant mixture undergoes polymerization, and the like. Further, when colorants are added during the polymer preparing stage, it is preferable that colorants of which surface has been subjected to treatment employing coupling agents, and the like, so that radical polymerization is not hindered.

Further, added as fixability improving agents may be low molecular weight polypropylene (having a number average molecular weight of 1,500 to 9,000), low molecular weight polyethylene, paraffin wax, Fischer-Tropsch wax, ester wax and the like.

The releasing agent employed invention is preferably an ester wax represented by the following Formula (2).

$$R_3—(OCO—R_4)_n \quad (2)$$

wherein n represents an integer of 1 to 4, preferably from 3 to 4, and particularly preferably 3 or 4, $R_3$ and $R_4$ represent a hydrocarbon group which may have a substituent. $R_3$ has from 1 to 40 carbon atoms, preferably from 1 to 20, more preferably from 2 to 5. $R_4$ has from 1 to 40 carbon atoms, preferably from 16 to 30, more preferably from 18 to 26.

The wax is advantageously employed in toner prepared by suspension polymerization particularly. Disadvantage due to surface property caused by the chain transfer agent attached to the end of the resin is remedied through the wax. Charge distribution of developer can be minimized and further image deterioration such as fog formation or toner scattering after long period of image forming is reduced by employing the wax represented by the Formula (2) in combination with the chain transfer agent represented by the Formula (1).

Specific examples of specified compounds, which are employed in the toner of the present invention, are listed.

$$CH_3—(CH_2)_{12}—COO—(CH_2)_{17}—CH_3 \quad (1)$$

$$CH_3—(CH_2)_{18}—COO—(CH_2)_{17}—CH_3 \quad (2)$$

$$CH_3—(CH_2)_{20}—COO—(CH_2)_{21}—CH_3 \quad (3)$$

$$CH_3—(CH_2)_{14}—COO—(CH_2)_{19}—CH_3 \quad (4)$$

$$CH_3—(CH_2)_{20}—COO—(CH_2)_6—O—CO—(CH_2)_{20}—CH_3 \quad (5)$$

(6)

$$CH_3—(CH_2)_{20}-COO—(CH_2)_2—\underset{}{\overset{CH_3}{\overset{|}{C}}}H—CH_2—O—CO—(CH_2)_{20}-CH_3$$

(7)

$$CH_3—(CH_2)_{22}-COO—(CH_2)_2—\overset{CH_3}{\overset{|}{C}}H—CH_2—O—CO—(CH_2)_{22}-CH_3$$

-continued (8)

$$CH_3—(CH_2)_{22}—COO—CH_2—\overset{CH_3}{\underset{CH_3}{C}}—CH_2—O—CO—(CH_2)_{22}—CH_3$$

(9)

$$CH_3—(CH_2)_{26}—COO—CH_2—\overset{CH_3}{\underset{CH_3}{C}}—CH_2—O—CO—(CH_2)_{26}—CH_3$$

(10)

$$\begin{array}{l} CH_2—O—CO—(CH_2)_{26}—CH_3 \\ | \\ CH—O—CO—(CH_2)_{26}—CH_3 \\ | \\ CH_2—O—CO—(CH_2)_{26}—CH_3 \end{array}$$

(11)

$$\begin{array}{l} CH_2—O—CO—(CH_2)_{22}—CH_3 \\ | \\ CH—O—CO—(CH_2)_{22}—CH_3 \\ | \\ CH_2—O—CO—(CH_2)_{22}—CH_3 \end{array}$$

(12)

$$\begin{array}{l} CH_2—OH \\ | \\ CH—O—CO—(CH_2)_{26}—CH_3 \\ | \\ CH_2—O—CO—(CH_2)_{26}—CH_3 \end{array}$$

(13)

$$\begin{array}{l} CH_2—OH \\ | \\ CH—O—CO—(CH_2)_{22}—CH_3 \\ | \\ CH_2—O—CO—(CH_2)_{22}—CH_3 \end{array}$$

(14)

$$\begin{array}{l} CH_2—OH \\ | \\ CH—OH \\ | \\ CH_2—O—CO—(CH_2)_{26}—CH_3 \end{array}$$

(15)

$$\begin{array}{l} CH_2—OH \\ | \\ CH—OH \\ | \\ CH_2—O—CO—(CH_2)_{22}—CH_3 \end{array}$$

(16)

$$CH_3—(CH_2)_{26}—COO—CH_2—\overset{CH_3}{\underset{CH_2—O—CO—(CH_2)_{26}—CH_3}{C}}—CH_2—O—CO—(CH_2)_{26}—CH_3$$

(17)

$$CH_3—(CH_2)_{20}—COO—CH_2—\overset{CH_2CH_3}{\underset{CH_2—O—CO—(CH_2)_{20}—CH_3}{C}}—CH_2—O—CO—(CH_2)_{20}—CH_3$$

(18)

$$CH_3—(CH_2)_{26}—COO—CH_2—\overset{CH_2—O—CO—(CH_2)_{26}—CH_3}{\underset{CH_2—O—CO—(CH_2)_{26}—CH_3}{C}}—CH_2—O—CO—(CH_2)_{26}—CH_3$$

-continued (19)

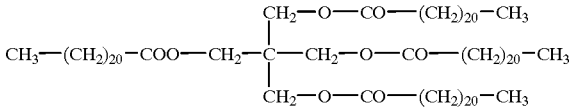

(20)

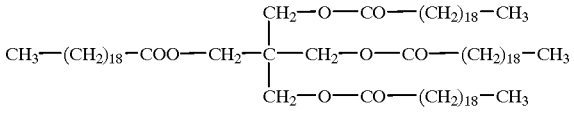

(21)

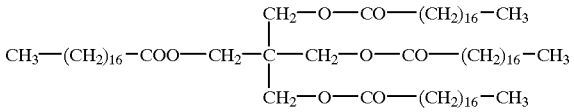

(22)

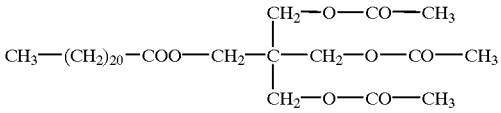

The content ratio of a releasing agent, wax or ester wax in the toner of the present invention is commonly from 1 to 30 percent by weight, is preferably from. 2 to 20 percent by weight, and is more preferably from 3 to 15 percent by weight.

The preferable preparation of the toner of the invention is dispersing a monomer into which a releasing agent is dissolved in water, conducting polymerization reaction by mini-emulsion polymerization to form particles containing a ester wax in the resin particles, and subjecting the resin particles and coloring particles to salting-out/fusion to form colored particles.

Employed as charge control agents may also be various types of those which are known in the art and can be dispersed in water. Specifically listed are nigrosine based dyes, metal salts of naphthenic acid or higher fatty acids, alkoxylated amines, quaternary ammonium salts, azo based metal complexes, salicylic acid metal salts or metal complexes thereof.

Incidentally, it is preferable that the number average primary particle diameter of particles of said charge control agents as well as said fixability improving agents is adjusted to about 10 to about 500 nm in the dispersed state.

In toners prepared employing a suspension polymerization method in such a manner that toner components such as colorants, and the like, are dispersed into, or dissolved in, so-called polymerizable monomers, the resultant mixture is suspended into a water based medium; and when the resultant suspension undergoes polymerization, it is possible to control the shape of toner particles by controlling the flow of said medium in the reaction vessel. Namely, when toner particles, which have a shape coefficient of at least 1.2, are formed at a higher ratio, employed as the flow of the medium in the reaction vessel, is a turbulent flow. Subsequently, oil droplets in the water based medium in a suspension state gradually undergo polymerization. When the polymerized oil droplets become soft particles, the coagulation of particles is promoted through collision and particles having an undefined shape are obtained. On the other hand, when toner particles, which have a shape coefficient of not more than 1.2, are formed, employed as the flow of the medium in the reaction vessel is a laminar flow. Spherical particles are obtained by minimizing collisions among said particles. By employing said methods, it is possible to control the distribution of shaped toner particles within the range of the present invention.

In the suspension polymerization method, it is possible to form a turbulent flow employing specified stirring blades and to readily control the resultant shape of particles. The reason for this phenomenon is not clearly understood. When the stirring blades 4 are positioned at one level, as shown in FIG. 1 (perspective view), the medium in stirring tank flows only from the bottom part to the upper part along the wall. Due to that, a conventional turbulent flow is commonly formed and stirring efficiency is enhanced by installing turbulent flow forming member (buffle) 9 on the wall surface of stirring tank 2. Though in said stirring apparatus, the turbulent flow is locally formed, the presence of the formed turbulent flow tends to retard the flow of the medium. As a result, shearing against particles decreases to make it almost impossible to control the shape of particles.

Reaction apparatuses provided with stirring blades, which are preferably employed in a suspension polymerization method, will be described with reference to the drawings.

Figure 2:
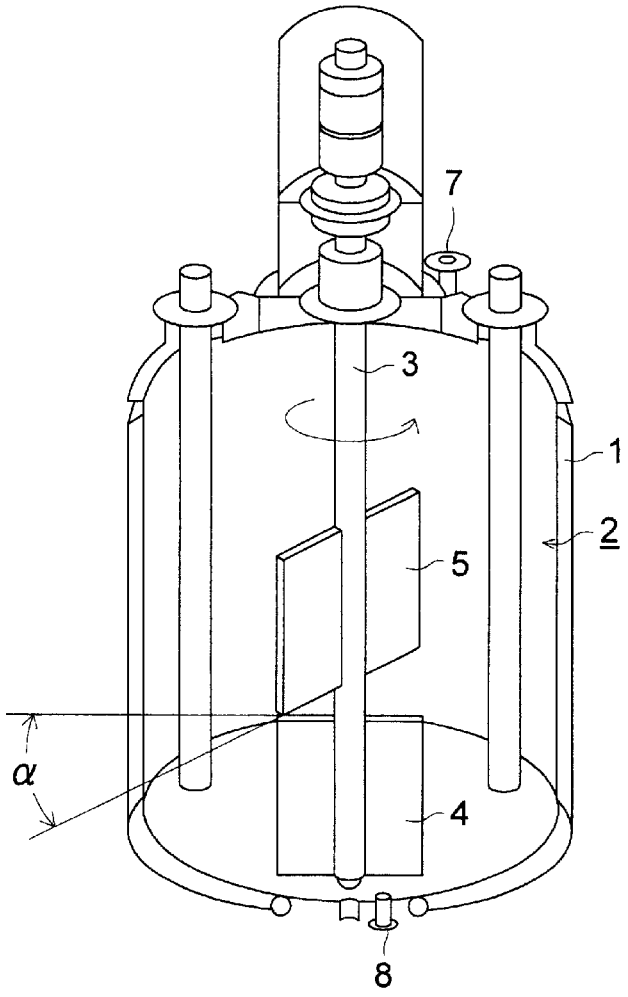
FIG. 2 is a perspective view of one example of a stirring tank equipped with stirring blades.
Figure 3:
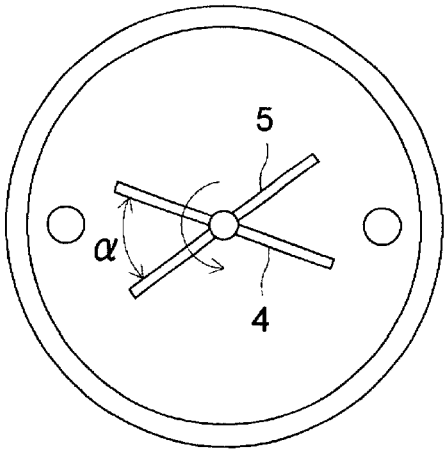
FIG. 3 is a cross-sectional view of the stirring tank shown in FIG. 2, viewed from above.

FIG. 2 is an example of a perspective view of the reaction apparatus having two-leveled stirring blades. The shape of the blade can be modified and the turbulent flow forming member can be installed according to the embodiments. Rotating shaft 3 is installed vertically at the center in vertical type cylindrical stirring tank of which exterior circumference of the stirring tank is equipped with a heat exchange jacket, and said rotating shaft 3 is provided with lower level stirring blades 4 installed near the bottom surface of said stirring tank 4 and upper level stirring blade 5. The upper level stirring blades 5 are arranged with respect to the lower level stirring blade so as to have a crossed axis angle $\alpha$ advanced in the rotation direction. When the toner of the presents invention is prepared, said crossed axis angle $\alpha$ is preferably less than 90 degrees. The lower limit of said crossed axis angle $\alpha$ is not particularly limited, but it is preferably at least about 5 degrees, and is more preferably at least 10 degrees. Incidentally, when stirring blades are constituted at three levels, the crossed axis angle between adjacent blades is preferably less than 90 degrees.

By employing the constitution as described above, it is assumed that, firstly, a medium is stirred employing stirring blades 5 provided at the upper level, and a downward flow is formed. It is also assumed that subsequently, the downward flow formed by upper level stirring blades 5 is accelerated by stirring blades 4 installed at a lower level, and another flow is simultaneously formed by said stirring blades 5 themselves, as a whole, accelerating the flow. As a result, it is further assumed that since a flow area is formed which has large shearing stress in the turbulent flow, it is possible to control the shape of the resultant toner.

Incidentally, in FIG. 2, arrows show the rotation direction, reference numeral 7 is upper material charging inlet, 8 is a lower material charging inlet.

Herein, the shape of the stirring blades is not particularly limited, but employed may be those which are in square plate shape, blades in which a part of them is cut off, blades having at least one opening in the central area, having a so-called slit, and the like.

Figure 4:
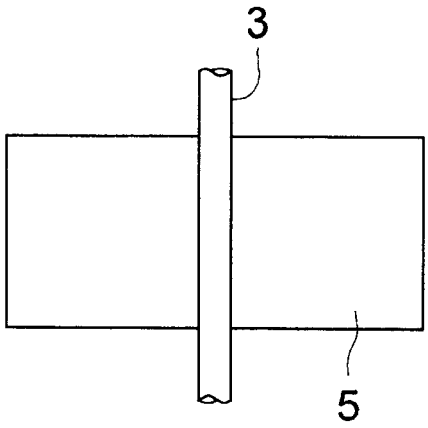
FIG. 4 is a schematic view of various stirring blades.
Figure 4:
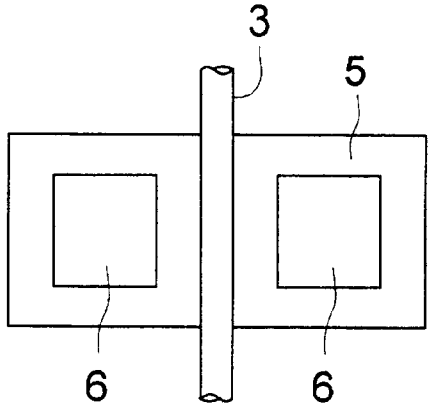
Figure 4:
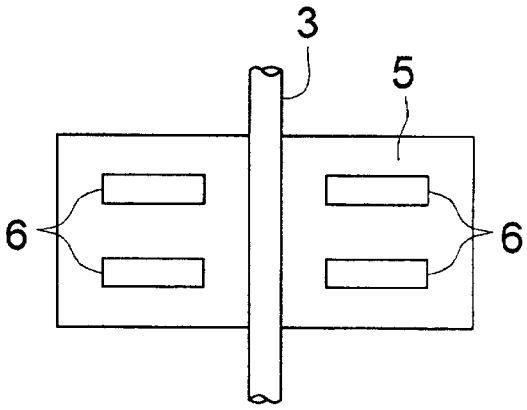
Figure 4:
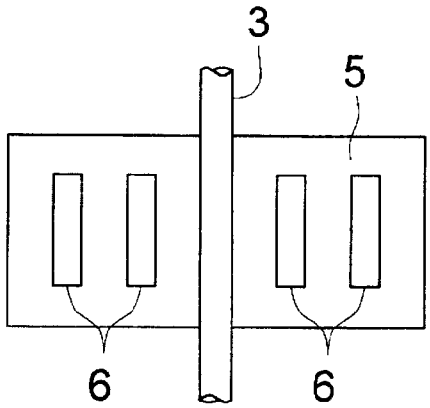
Figure 5:
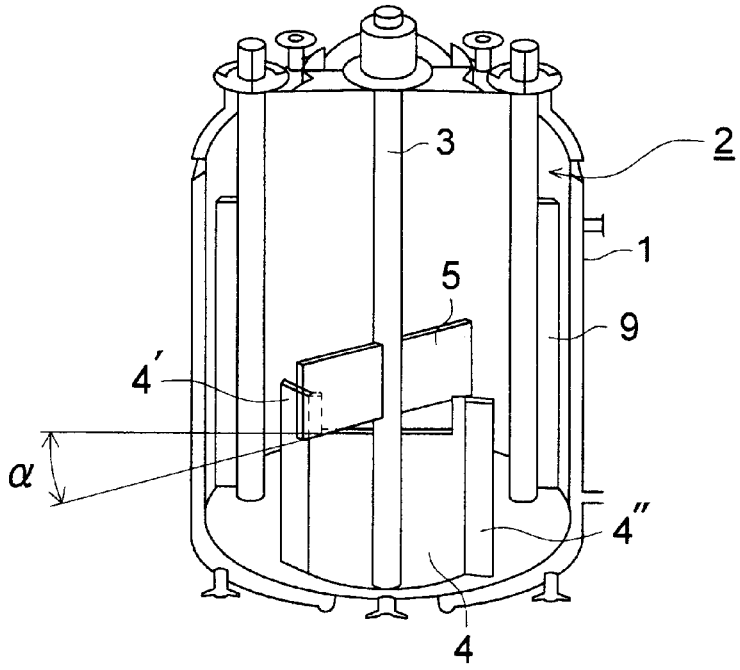
FIG. 5 is a perspective view of one example of a stirring tank equipped with stirring blades.

FIG. 4 describes specific examples of the shape of said blades. Stirring blade shown in FIG. 4(*a*) has no central opening; stirring blade shown in FIG. 4(*b*) has large central opening areas 6; stirring blade 5 shown in FIG. 4(*c*) has rectangular openings 6 (slits); and stirring blade 5 shown in FIG. 4(*d*) has oblong openings 6 shown in FIG. 4(*d*). Further, when stirring blades of a three-level configuration are installed, openings which are formed at the upper level stirring blade and the openings which are installed in the lower level may be different or the same.

Figure 6:
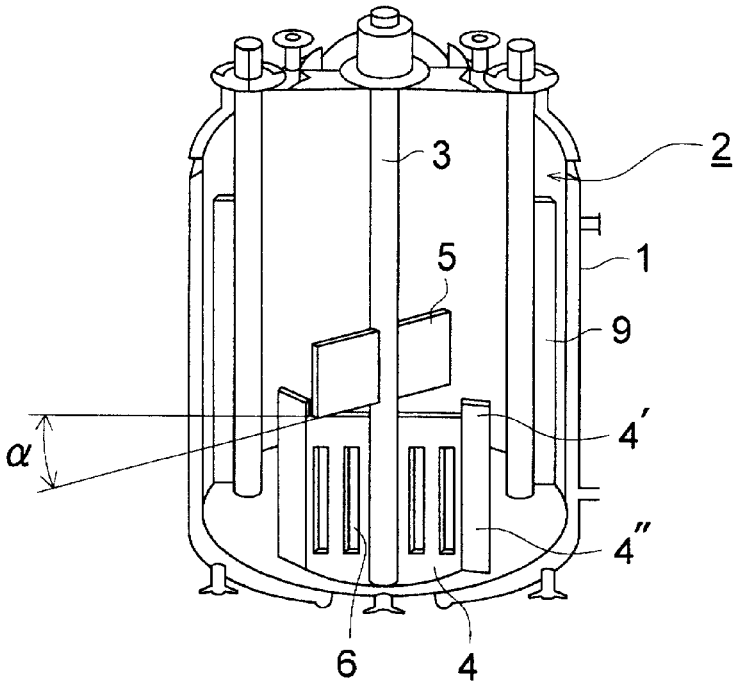
FIG. 6 is a perspective view of another example of a stirring tank equipped with stirring blades.

FIGS. 5 through 9 each show a perspective view of a specific example of a reaction apparatus equipped with stirring blades which may be preferably employed. In the reaction apparatus shown in FIG. 5, projections and/or folded parts are formed on the end portion of stirring blade. In FIG. 6 fins, folded parts are formed on the end portion of lower level stirring blade as well as slits are formed on the lower level stirring blade. In the reaction apparatus shown in FIG. 7, folded parts and fins are formed on the end portion of lower level stirring blade. In the reaction apparatus shown in FIG. 8, slits are formed on the upper level stirring blade and folded parts and fins are formed on the end portion of lower level stirring blade. In the reaction apparatus shown in FIG. 9, 3 leveled stirring blades are installed. The folded angle is preferably between 5 and 45 degrees when said folded sections are formed.

Stirring blades having such folded sections 4" or 5", stirring blades which have upward and downward projections (fins) 4' or 5', all generate an effective turbulent flow.

Still further, the space between the upper and the lower stirring blades is not particularly limited, but it is preferable that such a space is provided between stirring blades. The specific reason is not clearly understood. It is assumed that a flow of the medium is formed through said space, and the stirring efficiency is improved. However, the space is generally in the range of 0.5 to 50 percent with respect to the height of the liquid surface in a stationary state, and is preferably in the range of 1 to 30 percent.

Further, the size of the stirring blade is not particularly limited, but the sum height of all stirring blades is between 50 and 100 percent with respect to the liquid height in the stationary state, and is preferably between 60 and 95 percent.

Figure 7:
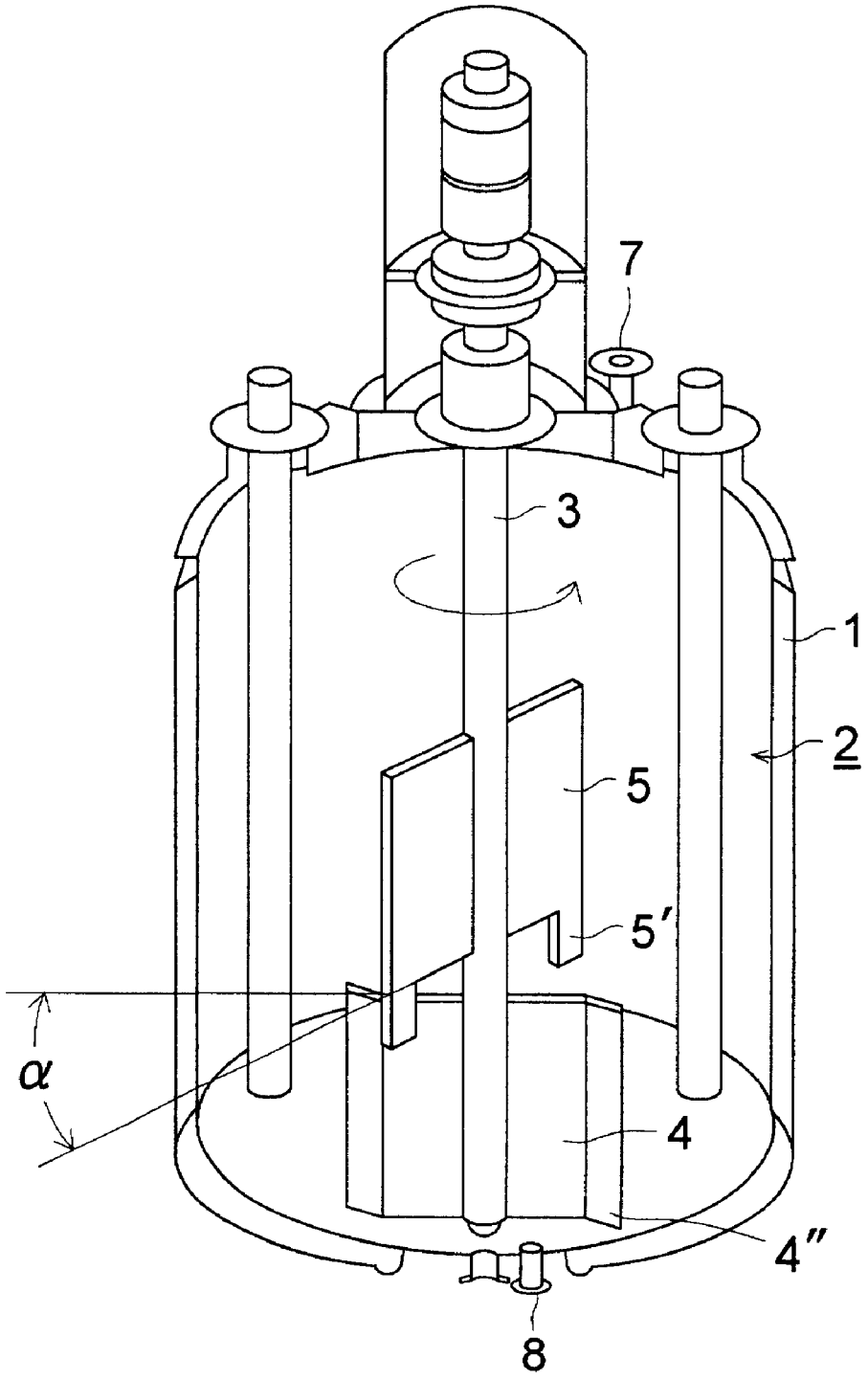
FIG. 7 is a perspective view of still another example of a stirring tank equipped with stirring blades.
Figure 8:
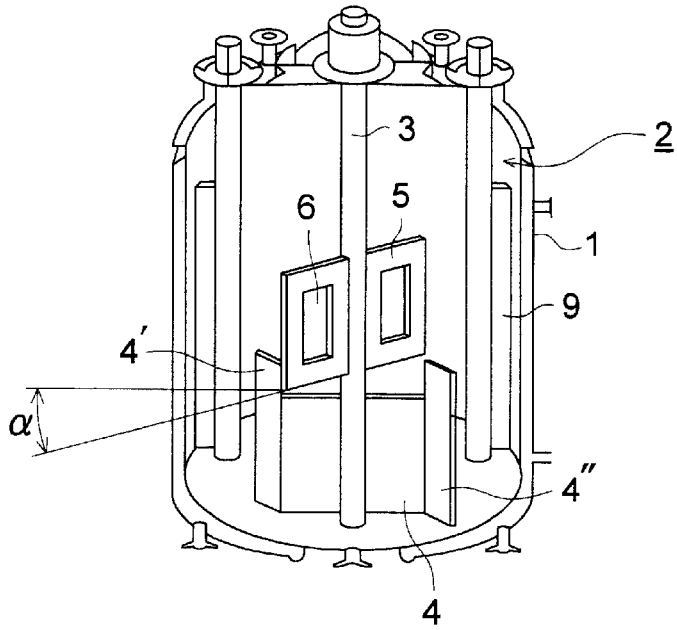
FIG. 8 is a perspective view of yet another example of a stirring tank equipped with stirring blades.
Figure 9:
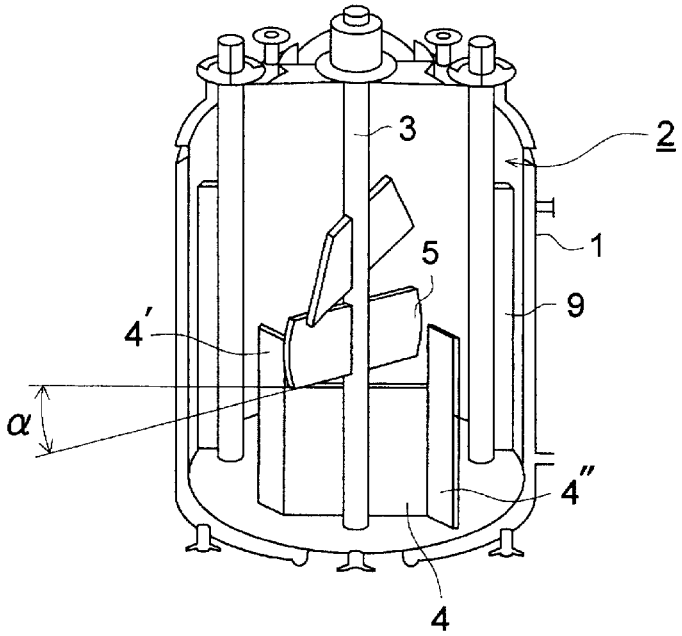
FIG. 9 is a perspective view of a final example of a stirring tank equipped with stirring blades.

Still further, FIG. 7 shows one example of a reaction apparatus employed when a laminar flow is formed in the suspension polymerization method. Said reaction apparatus is characterized in that turbulent flow forming member, obstacles such as a baffle plate, is not provided. In this instance it is preferable to employ plural blades configuration, wherein the upper level stirring blades are arranged with respect to the lower level stirring blade so as to have a crossed axis angle $\alpha$ advanced in the rotation direction, similarly to those employed to form turbulent flow.

Employed as said stirring blades may be the same blades which are used to form a laminar flow in the aforementioned suspension polymerization method. Stirring blades are not particularly limited as long as a turbulent flow is not formed, but those comprised of a rectangular plate as shown in FIG. 4(*a*), which are formed of a continuous plane are preferable, and those having a curved plane may also be employed.

In the method of polymerization employing salting-out or fusing resin particles in water based medium, it is possible to control the shape and its distribution of the whole toner optionally by controlling the flow of medium and temperature in a reaction tank during the fusion process and also controlling the heating temperature, rotation number of stirring and time during the shape control process after fusion process.

In other word, in the method of polymerization employing salting-out or fusing resin particles in water based medium, it is possible to prepare a toner having the shape coefficient and uniform shape distribution according to the invention by making the flow laminar in a reaction tank during the fusion process and employing stirring blades and stirring tank which enable to make the temperature distribution uniform in the tank and controlling the heating temperature, rotation number of stirring and time during the fusion process and shape control process. The reason is assumed that the shape distribution becomes uniform because a strong stress is not applied to the particles during coagulation and fusion and, as a result, the temperature distribution in the tank is uniform in the laminar flow with accelerated speed when fusion is conducted in the laminar flow. Further shape of the toner particles are optionally controlled since the fused particles are made spherical gradually by heating and stirring during the shape controlling process thereafter.

For a stirring blade and stirring tank employed in the coagulation or fusion polymerization method, it is applicable those employed in the suspension polymerization method wherein a laminar flow is formed, for example those shown in FIG. 7. Said reaction apparatus is characterized in that turbulent flow forming member, obstacles such as a baffle plate, is not provided. In this instance it is preferable to employ plural blades configuration, wherein the upper level stirring blades are arranged with respect to the lower level stirring blade so as to have a crossed axis angle $\alpha$ advanced in the rotation direction, similarly to those employed to form turbulent flow.

Employed as said stirring blades may be the same blades which are used to form a laminar flow in the aforementioned suspension polymerization method. Stirring blades are not particularly limited as long as a turbulent flow is not formed, but those comprised of a rectangular plate as shown in FIG. 4(*a*), which are formed of a continuous plane are preferable, and those having a curved plane may also be employed.

Further, as the toner shape of the present invention, an average value (an average circularity) of the shape coefficient (circularity) described by the formula shown below is preferably from 0.930 to 0.980, and is more preferably from 0.940 to 0.975.

Shape coefficient=(circumferential length of a circle obtained based on the diameter equivalent to a circle)/(circumferential length of the projected toner image)

The shape coefficient preferably has a narrow distribution, and the standard deviation of the circularity is preferably not more than 0.10. The CV value obtained by the formula shown below is preferably less than 20 percent, and is more preferably less than 10 percent.

CV value=(standard deviation of circularity/average circularity)

By adjusting said average circularity to the range of from 0.930 to 0.980, it is possible to make the toner shape undefined and to make heat transfer more efficient so that fixability can be further improved. Namely, by adjusting the average circularity to not more than 0.980, it is possible to enhance fixability. Further by adjusting the average circularity to at least 0.930, the degree of undefined particle shape is controlled so that pulverization properties of particles due to stress during extended use can be retarded.

By adjusting the standard deviation of the circularity to not more than 0.10, it is possible to prepare toner particles having a uniform shape and to minimize the difference in fixability between toner particles. As a result, an increase in the fixing ratio as well as effects to minimize staining of the fixing unit is further exhibited. Further, by adjusting the CV value to less than 20 percent, it is possible to narrow the size distribution in the same manner and to more markedly exhibit fixability enhancing effects.

Methods for measuring said shape coefficient are not limited. For example, toner particles are enlarged by a factor of 500 employing an electron microscope and photographed. Subsequently, the circularity of at least 500 toner particles is determined, employing an image analysis apparatus. The arithmetic average is then obtained so that an average circularity can be calculated. Further, as a simple measurement method, it is possible to conduct measurement, employing FPIA-1000 (produced by Toa Iyodenshi Co., Ltd.).

The optimal finishing time of processes may be determined while monitoring the properties of forming toner particles (colored particles) during processes of polymerization, fusion, and shape control of resin particles to control the shape of particles.

Monitoring as described herein means that measurement devices are installed in-line, and process conditions are controlled based on measurement results. Namely, a shape measurement device, and the like, is installed in-line. For example, in a polymerization method, toner, which is formed employing association or fusion of resin particles in water-based media, during processes such as fusion, the shape as well as the particle diameters, is measured while sampling is successively carried out, and the reaction is terminated when the desired shape is obtained.

Monitoring methods are not particularly limited, but it is possible to use a flow system particle image analyzer FPIA-2000 (manufactured by Toa Iyodenshi Co.). Said analyzer is suitable because it is possible to monitor the shape upon carrying out image processing in real time, while passing through a sample composition. Namely, monitoring is always carried out while running said sample composition from the reaction location employing a pump and the like, and the shape and the like are measured. The reaction is terminated when the desired shape and the like is obtained.

The volume average particle diameter of the toner of the present invention is measured employing a Coulter Counter TA-11 or a Coulter Multisizer (both manufactured by Coulter Co.). In the present invention, employed was the Coulter Multisizer which was connected to an interface which outputs the particle size distribution (manufactured by Nikkaki), as well as on a personal computer. Employed as used in said Multisizer was of a 100 $\mu$m aperture. The volume and the number of particles having a diameter of at least 2 $\mu$m were measured and the size distribution as well as the average particle diameter was calculated. The number particle distribution, as described herein, represents the relative frequency or toner particles with respect to the particle diameter, and the volume average particle diameter as described herein expresses the median diameter in the number paricle size distribution.

The diameter of the toner particles of the present invention is preferable between 3 and 8 $\mu$m in terms of the volume average particle diameter. When toner particles are formed employing a polymerization method, it is possible to control said particle diameter utilizing the concentration of coagulants, the added amount of organic solvents, the fusion time, or further the composition of the polymer itself.

By adjusting the volume average particle diameter from 3 to 8 $\mu$m, it is possible to decrease the presence of toner and the like which is adhered excessively to the developer conveying memeber or exhibits low adhesion, and thus stabilize developability over an extended period of time. At the same time, improved is the halftone image quality as well as general image quality of fine lines, dots, and the like.

Measurement Conditions

Aperture: 100 $\mu$m

Sample preparation method: added to 50 to 100 ml of an electrolytic solution (ISOTON R-11, manufactured by Coulter Scientific Japan Co) is a suitable amount of a surface active agent (a neutral detergent) and stirred. Added to the resulting mixture is 10 to 20 mg of a sample to be measured. To prepare the sample, the resulting mixture is subjected to dispersion treatment for one minute employing an ultrasonic homogenizer.

Furthermore, the toner of the present invention may be advantageously employed when combined with external additives of fine particles, such as fine inorganic particles and fine organic particles. As the reason for such combining, it is assumed that burying and releasing of external additives may be effectively minimized, and its effect is markedly exhibited.

Preferably employed as such fine inorganic particles are inorganic oxide particles such as silica, titania, alumina, and the like. These fine inorganic particles are preferably subjected to hydrophobic treatment employing silane coupling agents, titanium coupling agents, and the like. The degree of the hydrophobic treatment is not particularly limited, however the degree is preferably between 40 and 95 measured as methanol wettability. The methanol wettability as described herein means the evaluation of wettability for methanol.

In this method, 0.2 g of fine inorganic particles is weighed and added to 50 ml of distilled water placed in a 200 ml beaker. Methanol is slowly added dropwise while slowly stirring from a burette of which top is immersed in the solution until entire fine organic particles are wet. The degree of hydrophobicity is calculated from the formula given below:

$$\text{Degree of hydrophobicity}=a/(a+50)\times 100$$

wherein "a" (in ml) represents the amount of methanol required for making fine inorganic particles perfectly wet.

The added amount of said external additives is between 0.1 and 5.0 percent by weight of the toner, and is preferably between 0.5 and 4.0 percent by weight. As external additives, various materials may be employed in combination.

Several cases may be considered for application of the toner of the present invention, in which, for example, comprising magnetic materials, it is employed as a single component magnetic toner; mixed with a so-called carrier, it is employed as a two-component toner; or a non-magnetic toner is individually employed; and the like. Said toner may be suitably employed for all cases. However, in the present invention, mixed with the carrier, the toner is preferably employed as a two-component developer material.

Employed as carriers constituting the two-component developer material, may be materials which are conventionally known in the art, such as metals, e.g., iron, ferrite, magnetite, and the like, and alloys of said metals with metals such as aluminum, lead, and the like, as magnetic particles. Specifically, ferrite particles are preferred. The volume average particle diameter of said magnetic particles is preferably between 15 and 100 $\mu$m, and is more preferably between 25 and 60 $\mu$m. The volume average particle diameter of carrier may be measured employing a laser diffraction type particle size distribution measuring device, "HELOS" (manufactured by SYNPATEC Co.) equipped with a wet-type homogenizer as a representative device.

Preferred carriers are those which are further coated with a resin or a so-called resin-dispersed type carrier prepared by dispersing magnetic particles into a resin. Resin compositions for coating are not particularly limited. For example, employed may be olefin based resins, styrene based resins, styrene/acryl based resins, silicone based resins, ester based resins, fluorine containing polymer based resins, and the like. Furthermore, resins to constitute the resin-dispersed type carrier are also not particularly limited, and those known in the art may be employed. For example, employed may be styrene acrylic resins, polyester resins, fluorine based resins, phenol resins, and the like.

Figure 10:
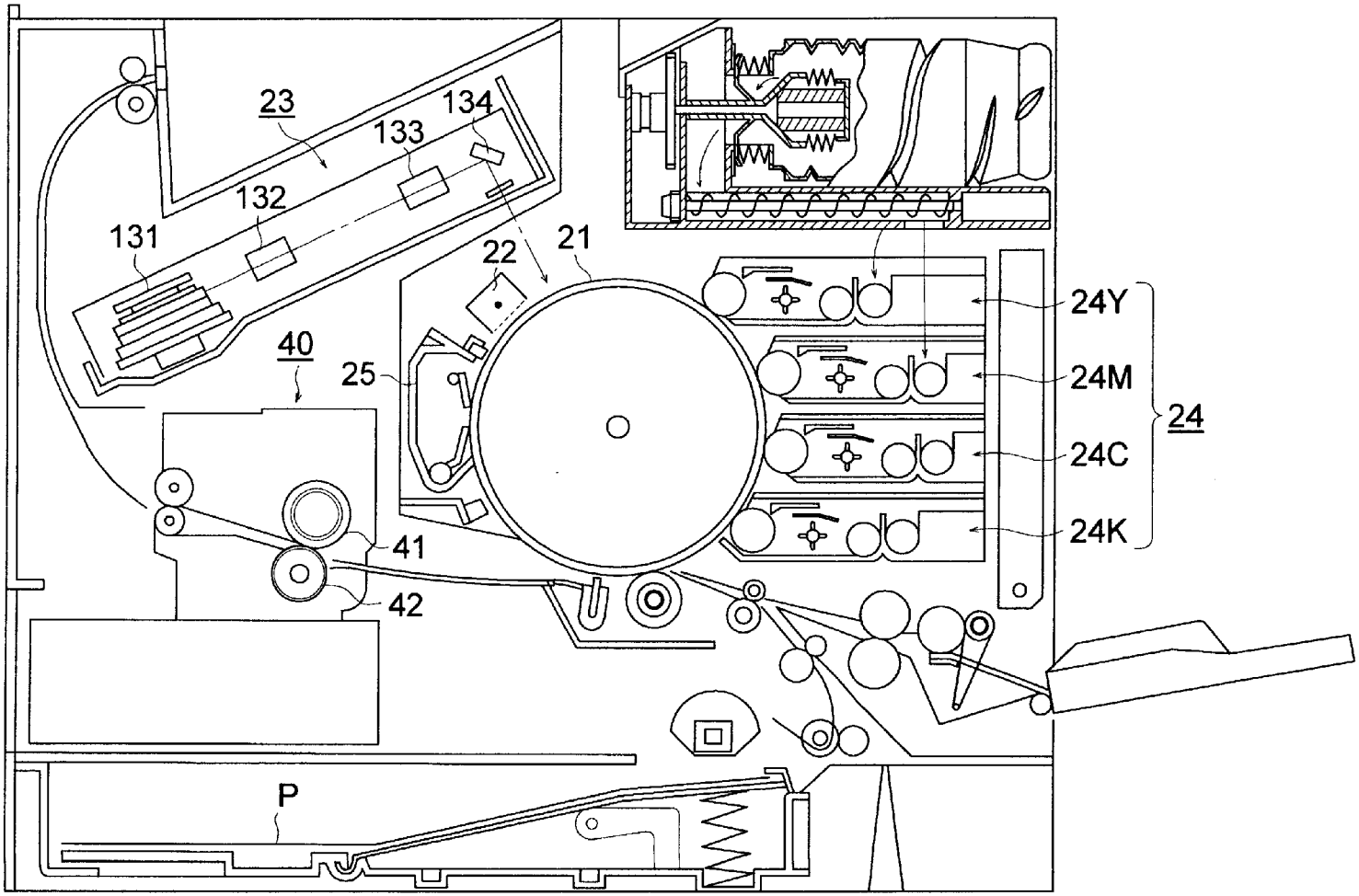
FIG. 10 is a cross-sectional schematic view of the color image forming apparatus of the present invention.

Herein, shown is the cross-sectional view of a color image forming apparatus as one example of the image forming apparatus according to the present invention. In FIG. 10, numeral 21 is a photoreceptor drum which is a latent image bearing body. Said photoreceptor drum is prepared by applying an OPC photoreceptor (an organic photoreceptor) onto the drum substrate, and rotates clockwise as shown in FIG. 10, while being grounded. Numeral 22 is a scorotron charging unit, employed as a charging means, which results in uniform charging at high electric potential VH on the circumferential surface of said photoreceptor drum 21, utilizing the electric potential maintained grid at grid electric potential VG as well as corona discharge wires. Prior to charging employing said scorotron charging unit, it is preferable that in order to eliminate the hysteresis of said photoreceptor until previous prints, the circumferential surface of said photoreceptor is subjected to charge elimination through pre-exposure employing PCL (pre-charging charge eliminator), utilizing light-emitting diodes and the like.

After uniformly charging photoreceptor 21, image exposure is carried out based on image signals, employing exposure means 23. Exposure means 23 comprises a light emitting source comprised of a laser diode (not shown), and the primary scanning is carried out in such a manner that the emitted light passes through rotating polygonal mirror 131, fθ lens 132, and cylindrical lens 133, and deflected its light path with reflection mirror 134.

In synchronizing with the rotation (secondary scanning) of photoreceptor drum 21, image exposure is carried out to form latent images. In the present example, the exposure of a text area is carried out and the reversal image is formed so that the text area results in lower electric potential VL.

Around photoreceptor drum 21, development means 24Y, 24M, 24C, and 24K are disposed, which comprise each of two components developers comprised of yellow (Y), magenta (M), cyan (C), black (K) toners, and the like, and carriers.

Image forming processes will be now described. First, as a first color, for example, yellow development is carried out. A common developer is comprised of a carrier comprised of ferrite cores of which surface coated with insulating resins, and a toner comprised of polyester particles as the main material, desired pigments, charge control agents, silica, titanium oxide, and the like. The layer of said developer is formed on a development sleeve employing a layer forming means, and the thickness is adjusted to from 100 to 600 $\mu$m. Subsequently, the resulting developer is conveyed to a development zone.

In the development zone, the gap between said development sleeve and photoreceptor drum 21 is set in the range of from 0.2 to 1.0 mm which is larger than the thickness of said developer layer. AC bias of VAC and DC bias of VDC are superposed and applied to said gap. Since the polarity of VDC and VH, and the charge of toner is the same as each other, the toner, which is provided with a chance to leave from the carrier due to VAC, does not adhere to a VH area, having a higher electric potential than VDC, but adheres to a VL area having a lower electric potential than VDC. As a result, an image is visualized (reversal development).

After completing image visualization of the first color, the magenta image forming process of a second color starts. Uniform charging is again carried out employing said scorotron charging unit, and a latent image is formed based on the second color image data, employing said exposure means 23.

The entire circumferential surface of photoreceptor drum 21 is again charged at VH electric potential. Subsequently, a latent image, which is the same as in the first color, is formed on the area, which has not been used for the first color image, and then developed. In the first color image area which is subjected to the repeated development, a VM' latent image is formed due to the light-shielding by the adhered toner of the fist color and the charge of the toner itself, and development is carried out in accordance with the difference in electric potential between VDC and VM'. In the superimposed area of said first color and second color, when the first color development is carried out upon forming a VL latent image, the balance between the first color and the second color is lost. Therefore, the exposure amount for the first color is reduced and occasionally, intermediate electric potential VM is used so as to be VH>VM>VL.

Regarding a third color cyan, and a fourth color black, image forming processes, which are the same as for magenta, are carried out, and four visualized color images are formed on the circumferential surface of said photoreceptor drum 21.

On the other hand, a sheet of recording material (recording sheet of paper, and the like) P, which is conveyed from a paper feeding cassette via a half-moon roller, temporarily stops near the pair of a resist roller (paper feeding roller) via a feed-out roller, and is then conveyed to a transfer zone by the rotation action of said resist rollers, when transfer timing is matched.

In said transfer zone, a transfer means is brought into pressure contact with the circumferential surface of photoreceptor drum 21, while being synchronized with transfer timing, and the fed recording material P is introduced between them so that multicolor images are inclusively transferred.

Subsequently, recording material is subjected to charge elimination, utilizing a separation means, separated from the circumferential surface of photoreceptor drum 21, and conveyed to a fixing unit (a fixing means) 40. In said fixing unit, heat and pressure are applied to the toner employing heating roller (an upper roller) 41 and pressure applying roller (a lower roller) 42 so that said toner is melt-fixed. Thereafter, resulting recording material P is ejected onto a paper ejecting tray via a paper ejecting roller. Incidentally, after passing said recording material P, said transfer means withdraws from the circumferential surface of photoreceptor drum 21, and prepares for next toner image formation.

On the other hand, photoreceptor drum 21, which is separated from recording material P, is subjected to charge eliminating employing a charge eliminator, and thereafter, is subjected to removal of the residual toner and cleaning through pressure contact with the blade of cleaning means 25. Subsequently, said photoreceptor drum 21 is again subjected to charge elimination employing said PCL, and then is charged employing said scorotron charging unit, and enters into next image forming process. Incidentally, after cleaning the photoreceptor surface, said blade immediately moves and withdraws from the circumferential surface of photoreceptor drum 21. The waste toner, which is scraped into cleaning means 25 employing said blade, is discharged employing screws, and stored in the waste toner recovery container (not shown).

As suitable fixing methods employed in the present invention, it is possible to list so-called contact heating systems. Specifically, as said contact heating systems, it is possible to list a heat pressure fixing system, a heating roll fixing system, and a pressure contact heat fixing system in which fixing is carried out employing a rotating pressure applying member including a heating body stationary fixed.

The heat roller fixing system is often constituted employing an upper roller prepared in such a manner that a cylindrical metal roller comprised of iron, aluminum, and the like, having a heating source in the interior is covered with tetrafluoroethylene, polytetrafluoroethylene-perfluoroalkoxyvinyl ether copolymers and the like, and a lower roller comprised of silicone rubber and the like. The representative example of said heating source is one which comprises a line shaped heater and heats the surface of said upper roller in the temperature range of from 120 to 200° C. In the fixing section, pressure is applied between the upper roller and the lower roller so that the lower roller is deformed to form so-called nip. The width of said nip is generally from 1 to 10 mm, and is preferably from 1.5 to 7 mm. The linear speed of fixing is preferably from 40 to 600 mm/second. When said nip is narrow, it is extremely difficult to uniformly provide heat to toner, whereby non-uniform fixing occurs. On the other hand, when said nip is broad, the melt of resins is accelerated, whereby problems occur in which excessive fixing offsetting results.

Fixing cleaning mechanisms may be provided. As this system, it is possible to employ a system which supplies silicone oil onto an upper fixing roller or films, and a method which carries out cleaning, employing a pad impregnated with silicone oil, a roller, a web and the like.

Said fixing unit may be provided with said cleaning mechanism. Employed as cleaning systems are a system in which various types of silicone oil are supplied to a fixing film, or a system which carries out cleaning, employing a pad impregnated with silicone oil, a roller, a web and the like.

Incidentally, as silicone oil, it is possible to employ polydimethylsiloxane, polymethylphenysiloxane, polydiphenylsiloxane, and the like. Further, it is possible to suitably use siloxanes comprising fluorine.

The representative embodiments of the present invention will now be described as examples.

A solution which had been prepared by dissolving an anionic surface active agent (sodium dodecylbenzene-sulfonate: SDS) in deionized water (2,760 g) was charged into a 5,000 ml separable flask fitted with a stirring unit, a thermal sensor, a cooling pipe, and a nitrogen gas inlet unit. Said solution was stirred at 230 rpm under a nitrogen atmosphere, and the interior temperature was raised to 80° C. Separately, 72.0 g of Exemplified Compound (19) was added to a monomer comprised of 115.1 g of styrene, 42.0 9 of n-butyl acrylate, and 10.9 g of methacrylic acid, and were dissolved while being heated to prepare a monomer solution.

Herein, both said heated solutions were mix-dispersed employing a mechanical type homogenizer having a circulation channel, and emulsified particles, having a uniform dispersed particle diameter were obtained. Subsequently, a solution prepared by dissolving 0.84 g of a polymerization initiator (potassium persulfate: KPS) in 200 g of deionized water was added to the resulting dispersion, and the resulting mixture was heated at 80° C. for 3 hours to form latex particles. Subsequently, a solution prepared by dissolving 7.73 g of a polymerization initiator (KPS) in 240 ml of deionized water was further added, and 15 minutes later, a composition prepared by mixing 383.6 g of styrene, 140.0 g of n-butyl acrylate, 36.4 g of methacrylic acid, and 13.7 g of thioglycerin was added dropwise at 80° C. over 126 minutes. After the dropwise addition, the resulting mixture was stirred for 60 minutes under heat, and then cooled to 40° C. to obtain latex particles.

Said resulting latex was designated as Latex 1.

LATEX PREPARATION EXAMPLE 2

Latex particles were obtained in the same manner as Latex Preparation Example 1, except that thioglycerin was replaced with 15.0 g of thioglycolic acid ester and Exemplified Compound (19) was replaced with 120.0 g of Exemplified Compound (18). Said latex was designated as Latex 2.

LATEX PREPARATION EXAMPLE 3

Latex particles were obtained in the same manner as Latex Preparation Example 1, except that thioglycerin was replaced with 15.0 g of 2-ethylhexyl thioglycolate. Said latex was designated as Latex 3.

LATEX PREPARATION EXAMPLE 4

Latex particles were obtained in the same manner as Latex Preparation Example 1, except that thioglycerin was replaced with 16.0 g of thioglycolic acid ester of trimethylolpropane. Said latex was designated as Latex 4.

LATEX PREPARATION EXAMPLE 5

Latex particles were obtained in the same manner as Latex Preparation Example 1, except that thioglycerin was replaced with 15.0 g of 2-ethylhexy 3-mercaptopropionate. Said latex was designated as Latex 5.

LATEX PREPARATION EXAMPLE 6

Latex particles were obtained in the same manner as Latex Preparation Example 1, except that thioglycerin was replaced with 15.0 g of decyl 3-mercaptopropionate. Said latex was designated as Latex 6.

LATEX PREPARATION EXAMPLE 7

Latex particles were obtained in the same manner as Latex Preparation Example 1, except that thioglycerin was replaced with 15.0 g of octyl 3-mercaptopropionate. Said latex was designated as Latex 7.

LATEX PREPARATION EXAMPLE 8

Latex particles were obtained in the same manner as Latex Preparation Example 1, except that thioglycerin was replaced with 22.0 g of pentaerythritoltetrakis 3-mercaptopropionate. Said latex was designated as Latex 8.

LATEX PREPARATION EXAMPLE 9

Latex particles were obtained in the same manner as Latex Preparation Example 1, except that thioglycerin was replaced with 25.0 g of 3-mercaptopropionic acid estar of trimethylolpropane. Said latex was designated as Latex 9.

LATEX PREPARATION EXAMPLE 10

Latex particles were obtained in the same manner as Latex Preparation Example 1, except that thioglycerin was replaced with 15.0 g of t-dodecylmercaptan. Said latex was designated as Latex 10.

TONER PREPARATION EXAMPLE

Preparation of Colored Particles 1Bk

While stirring, dissolved in 160 ml of deionized were 9.2 g of sodium dodecylsulfate. While stirring, gradually added to the resulting solution were 20 g of Regal 330R (carbon black manufactured by Cabot Corp.), and the resulting mixture was dispersed employing a Clearmix. The particle diameter of said dispersion was determined employing an Electrophoresis Light Scattering Photometer ELS-800 manufactured by Ohtsuka Denshi Co., whereby a weight average particle diameter of 112 nm was determined. Said dispersion was designated as "Colorant Dispersion 1".

While stirring, charged into 5 liter 4-necked flask fitted with a thermal sensor, a cooling pipe, a nitrogen inlet unit, and a stirring unit were 1,250 g of said "Latex 1", 2,000 ml of deionized water, and "Colorant Dispersion 1". After heating the resulting mixture to 30° C., 5N aqueous sodium hydroxide solution was added to said solution, after which the pH was adjusted to 10.0. Subsequently, an aqueous solution prepared by dissolving 52.6 g of magnesium hydroxide hexahydrate in 72 ml of deionized water was added while stirring at 30° C. over 10 minutes.

Thereafter, the resulting mixture was set aside for 3 minutes, and then heated to 90° C. within 6 minutes (temperature raising rate=10° C./minute). In such a state, the particle diameter was determined employing a Coulter Counter TA-II. When the volume average particle diameter reached 6.5 $\mu$m, an aqueous solution prepared by dissolving 115 g of sodium chloride in 700 ml of deionized water was added to stop the particle growth. Subsequently, while maintaining the resulting mixture at 90±2° C., said mixture was stirred for 6 hours, and was subjected to salting-out/fusion. Thereafter, the resulting product was cooled to 30° C. at a rate of 6° C./minute, and the pH was adjusted to 2.0 by addition of hydrochloric acid. Then, stirring was stopped. The prepared colored particles were filtered and repeatedly washed with deionized water. Thereafter the resulting colored particles were dried employing 40° C. air to obtain colored particles. Colored particles obtained as above were designated as "Colored Particles 1Bk".

Colored Particles 1Y

Colored particles were obtained in the same manner as above, except that said carbon black was replaced with C.I. Pigment Yellow 185. Said colored particles were designated as "Colored Particles 1Y".

Colored Particles 1M

Colored particles were obtained in the same manner as above, except that said carbon black was replaced with C.I. Pigment Red 122. Said colored particles were designated as "Colored Particles 1M".

Colored Particles 1C

Colored particles were obtained in the same manner as above, except that said carbon black was replaced with C.I. Pigment Blue 15:3. Said colored particles were designated as "Colored Particles 1C".

Latex 2 was employed for a group of Colored Particles 2. Thus Colored Particles 1 (Bk/Y/M/C) through 10 (Bk/Y/M/C) were prepared employing Latexes 2 through 10.

"Colored Particles 2Bk through 10C" were obtained as above while employing other "Latexes 2 through 10", except that carbon black as well as colorants were varied as shown in Table (1) below.

TABLE 1

| Colored Particles No. | Latex No. | Colorant Name |
|---|---|---|
| Colored Particles 1Bk | Latex 1 | Regal 330R |
| Colored Particles 1Y | Latex 1 | C.I. Pigment Yellow 185 |
| Colored Particles 1M | Latex 1 | C.I. Pigment Red 122 |
| Colored Particles 1C | Latex 1 | C.I. Pigment Blue 15:3 |
| Colored Particles 2Bk | Latex 2 | Regal 330R |
| Colored Particles 2Y | Latex 2 | C.I. Solvent Yellow 93 |
| Colored Particles 2M | Latex 2 | C.I. Pigment Red 122 |
| Colored Particles 2C | Latex 2 | C.I. Pigment Blue 15:3 |
| Colored Particles 3Bk | Latex 3 | Regal 330R |
| Colored Particles 3Y | Latex 3 | C.I. Solvent Yellow 93 |
| Colored Particles 3M | Latex 3 | C.I. Pigment Red 122 |
| Colored Particles 3C | Latex 3 | C.I. Pigment Blue 15:3 |
| Colored Particles 4Bk | Latex 4 | Regal 330R |
| Colored Particles 4Y | Latex 4 | C.I. Solvent Yellow 93 |
| Colored Particles 4M | Latex 4 | C.I. Pigment Red 122 |
| Colored Particles 4C | Latex 4 | C.I. Pigment Blue 15:3 |
| Colored Particles 5Bk | Latex 5 | Regal 330R |
| Colored Particles 5Y | Latex 5 | C.I. Solvent Yellow 162 |
| Colored Particles 5M | Latex 5 | C.I. Pigment Red 162 |
| Colored Particles 5C | Latex 5 | C.I. Pigment Blue 15:3 |
| Colored Particles 6Bk | Latex 6 | Regal 330R |
| Colored Particles 6Y | Latex 6 | C.I. Solvent Yellow 162 |
| Colored Particles 6M | Latex 6 | C.I. Pigment Red 122 |
| Colored Particles 6C | Latex 6 | C.I. Pigment Blue 15:3 |
| Colored Particles 7Bk | Latex 7 | Mogal L |
| Colored Particles 7Y | Latex 7 | C.I. Solvent Yellow 93 |
| Colored Particles 7M | Latex 7 | C.I. Pigment Red 122 |
| Colored Particles 7C | Latex 7 | C.I. Pigment Blue 15:3 |
| Colored Particles 8Bk | Latex 8 | Mogal L |
| Colored Particles 8Y | Latex 8 | C.I. Solvent Yellow 93 |
| Colored Particles 8M | Latex 8 | C.I. Pigment Red 122 |
| Colored Particles 8C | Latex 8 | C.I. Pigment Blue 15:3 |
| Colored Particles 9Bk | Latex 9 | Regal 330R |
| Colored Particles 9Y | Latex 9 | C.I. Pigment Yellow 185 |
| Colored Particles 9M | Latex 9 | C.I. Pigment Red 122 |
| Colored Particles 9C | Latex 9 | C.I. Pigment Blue 15:3 |
| Colored Particles 10Bk | Latex 10 | Regal 330R |
| Colored Particles 10Y | Latex 10 | C.I. Pigment Yellow 185 |
| Colored Particles 10M | Latex 10 | C.I. Pigment Red 122 |
| Colored Particles 10C | Latex 10 | C.I. Pigment Blue 15:3 |

COLORED PARTICLES PRODUCTION EXAMPLE 11Bk

EXAMPLE OF SUSPENSION POLYMERIZATION METHOD

Charged into a 4-necked flask fitted with a high speed stirring unit (a TK Homomixer) were 710 parts by weight of deionized water and 450 parts by weight of 0.1 mole/liter aqueous trisodium phosphate solution, and the resulting mixture was heated to 65° C. Subsequently, 68 parts by weight of 1.0 mole/liter calcium chloride were gradually added under the stirring condition of 12,000 rpm, whereby a water based dispersion medium comprised of a dispersion containing colloidal tricalcium phosphate was prepared.

Subsequently, 30 parts by weight of Ester Wax (19) were added to a dispersion which had been prepared by dispersing 165 parts by weight of styrene monomer, 35 parts by weight of n-butyl acrylate, and 14 parts by weight of carbon black (Regal 330R) employing a sand grinder, and were dissolved at 80° C. Thereafter, 2 parts by weight of thioglycerin and 10 parts by weight of 2,2'-azobis(2,4-dimethylvaleronitile), as the polymerization initiator, were gradually added to said water based dispersion medium while stirred at 12,000 rpm, whereby a solution comprising monomers was dispersed into water. Subsequently, the resulting dispersion underwent polymerization under a nitrogen gas flow at 65° C. for 10 hours while stirred at 200 rpm, employing a reaction apparatus in which the stirring blade was constituted as shown in FIG. 4(*b*).

After completing said polymerization, hydrochloric acid was added to remove tricalcium phosphate as the dispersion stabilizer. The resulting medium was then filtered, washed, and dried, whereby colored particles were prepared.

Said colored particles were designated as "Colored Particles 11Bk". Incidentally, during said polymerization, monitoring was performed. By controlling the liquid medium temperature, the rotation frequency of the stirrer, and the heating time, the shape as well as the variation coefficient of the shape coefficient was controlled. Further, the particle diameter, as well as the variation coefficient of the particle size distribution, was optionally controlled utilizing a classification method in a liquid medium.

COLORED PARTICLE PRODUCTION EXAMPLE 12Bk

EXAMPLE OF SUSPENSION POLYMERIZATION

Colored particles were obtained in the same manner as Colored Particle Production Example 11Bk, except that thioglycerin was replaced with 3 parts by weight of ethyl thioglycolate. Said colored particles were designated as Colored Particles 12Bk.

COLORED PARTICLE PRODUCTION EXAMPLE 13Bk

EXAMPLE OF SUSPENSION POLYMERIZATION

Colored particles were obtained in the same manner as Colored Particle Production Example 11Bk, except that thioglycerin was replaced with 3 parts by weight of 2-ethylhexyl thioglycolate. Said colored particles were designated as Colored Particles 13Bk.

COLORED PARTICLE PRODUCTION EXAMPLE 14Bk

EXAMPLE OF SUSPENSION POLYMERIZATION

Colored particles were obtained in the same manner as Colored Particle Production Example 11Bk, except that thioglycerin was replaced with octyl 3-mercaptoprpionate. Said colored particles were designated as Colored Particles 14Bk.

COLORED PARTICLE PRODUCTION EXAMPLE 15Bk

EXAMPLE OF SUSPENSION POLYMERIZATION

Colored particles were obtained in the same manner as Colored Particle Production Example 11Bk, except that thioglycerin was replaced with 3 parts by weight of trimethylolpropane 3-mercaptopropionate. Said colored particles were designated as Colored Particles 15Bk.

COLORED PARTICLE PRODUCTION EXAMPLE 16Bk

EXAMPLE OF SUSPENSION POLYMERIZATION

Colored particles were obtained in the same manner as Colored Particle Production Example 11Bk, except that thioglycerin was replaced with t-dodecylmercaptan. Said colored particles were designated as Colored Particles 16Bk.

TABLE 2

| Colored Particles No. | Average Circularity | Standard Deviation of Circularity | Circularity CV Value (in %) | Volume Average Particle Diameter |
|---|---|---|---|---|
| Colored Particles 1Bk | 0.964 | 0.031 | 3.2 | 6.5 |
| Colored Particles 1Y | 0.966 | 0.033 | 3.4 | 6.4 |
| Colored Particles 1M | 0.967 | 0.031 | 3.2 | 6.4 |
| Colored Particles 1C | 0.966 | 0.033 | 3.4 | 6.6 |
| Colored Particles 2Bk | 0.966 | 0.036 | 3.7 | 6.3 |
| Colored Particles 2Y | 0.966 | 0.036 | 3.7 | 6.4 |
| Colored Particles 2M | 0.967 | 0.038 | 3.9 | 6.4 |
| Colored Particles 2C | 0.969 | 0.037 | 3.8 | 6.3 |
| Colored Particles 3Bk | 0.962 | 0.042 | 4.4 | 6.4 |
| Colored Particles 3Y | 0.961 | 0.045 | 4.7 | 6.4 |
| Colored Particles 3M | 0.965 | 0.044 | 4.6 | 6.4 |
| Colored Particles 3C | 0.966 | 0.045 | 4.7 | 6.3 |
| Colored Particles 4Bk | 0.974 | 0.051 | 5.2 | 6.8 |
| Colored Particles 4Y | 0.974 | 0.052 | 5.3 | 7.1 |
| Colored Particles 4M | 0.972 | 0.050 | 5.2 | 6.9 |
| Colored Particles 4C | 0.972 | 0.051 | 5.2 | 6.9 |
| Colored Particles 5Bk | 0.970 | 0.034 | 3.5 | 6.3 |
| Colored Particles 5Y | 0.971 | 0.032 | 3.3 | 6.2 |
| Colored Particles 5M | 0.969 | 0.033 | 3.4 | 6.3 |
| Colored Particles 5C | 0.970 | 0.034 | 3.5 | 6.3 |
| Colored Particles 6Bk | 0.954 | 0.031 | 3.2 | 6.9 |
| Colored Particles 6Y | 0.956 | 0.030 | 3.1 | 6.7 |
| Colored Particles 6M | 0.957 | 0.033 | 3.4 | 6.8 |
| Colored Particles 6C | 0.956 | 0.031 | 3.2 | 6.8 |

TABLE 3

| Colored Particles No. | Average Circularity | Standard Deviation of Circularity | Circularity CV Value (in %) | Volume Average Particle Diameter (in $\mu$m) |
|---|---|---|---|---|
| Colored Particles 7Bk | 0.962 | 0.035 | 3.6 | 7.4 |
| Colored Particles 7Y | 0.963 | 0.034 | 3.5 | 7.3 |
| Colored Particles 7M | 0.964 | 0.036 | 3.7 | 7.2 |
| Colored Particles 7C | 0.965 | 0.035 | 3.6 | 7.1 |
| Colored Particles 8Bk | 0.957 | 0.032 | 3.3 | 6.2 |
| Colored Particles 8Y | 0.955 | 0.033 | 3.5 | 6.4 |
| Colored Particles 8M | 0.956 | 0.035 | 3.7 | 6.2 |
| Colored Particles 8C | 0.957 | 0.034 | 3.6 | 6.5 |
| Colored Particles 9Bk | 0.972 | 0.038 | 3.9 | 6.9 |
| Colored Particles 9Y | 0.973 | 0.037 | 3.8 | 6.9 |
| Colored Particles 9M | 0.973 | 0.035 | 3.6 | 7.0 |
| Colored Particles 9C | 0.972 | 0.039 | 4.0 | 6.8 |
| Colored Particles 10Bk | 0.964 | 0.032 | 3.3 | 6.9 |
| Colored Particles 10Y | 0.963 | 0.032 | 3.3 | 6.9 |
| Colored Particles 10M | 0.967 | 0.031 | 3.2 | 6.9 |
| Colored Particles 10C | 0.966 | 0.032 | 3.3 | 6.8 |
| Colored Particles 11Bk | 0.964 | 0.030 | 3.1 | 6.2 |
| Colored Particles 12BK | 0.965 | 0.032 | 3.3 | 6.1 |
| Colored Particles 13BK | 0.969 | 0.032 | 3.3 | 6.2 |
| Colored Particles 14BK | 0.968 | 0.030 | 3.1 | 6.3 |
| Colored Particles 15BK | 0.968 | 0.030 | 3.1 | 6.3 |
| Colored Particles 16BK | 0.966 | 0.031 | 3.2 | 6.2 |

Said circularity was determined employing FPIA-1000, using an analyzed sample amount of 0.3 microliter and the number of detected particles of from 1,500 to 5,000.

Further, colored particles group 10 "Colored particles 10Bk/Y/C" and Colored particles 16Bk are Comparative Examples.

TABLE 4

| Colored Particles (Group) No. | Peak Molecular Weight of the High Molecular Weight Component | Peak Molecular Weight of the Low Molecular Weight Component | Measured Molecular Weight of Resin: Number Average Molecular Weight | Measured Molecular Weight of Resin: Weight Average Molecular Weight |
|---|---|---|---|---|
| Colored Particles Group 1 | 243,000 | 21,000 | 5,900 | 43,000 |
| Colored Particles Group 2 | 242,000 | 22,000 | 5,800 | 45,000 |
| Colored Particles Group 3 | 242,000 | 20,000 | 5,900 | 48,000 |
| Colored Particles Group 4 | 242,000 | 21,000 | 5,900 | 43,000 |
| Colored Particles Group 5 | 251,000 | 19,000 | 5,900 | 49,000 |
| Colored Particles Group 6 | 243,000 | 21,000 | 5,900 | 43,000 |
| Colored Particles Group 7 | 245,000 | 19,000 | 6,300 | 56,000 |
| Colored Particles Group 8 | 269,000 | 20,000 | 7,200 | 69,000 |
| Colored Particles Group 9 | 242,000 | 21,000 | 5,000 | 42,000 |
| Colored Particles Group 10 | 242,000 | 19,000 | 4,300 | 51,000 |
| Colored Particles 11Bk | 244,000 | 19,000 | 6,500 | 72,000 |
| Colored Particles 12BK | 242,000 | 20,000 | 6,300 | 73,000 |
| Colored Particles 13Bk | 247,000 | 17,000 | 6,500 | 71,000 |
| Colored Particles 14Bk | 249,000 | 18,000 | 6,900 | 75,000 |
| Colored Particles 15Bk | 251,000 | 19,000 | 6,400 | 72,000 |
| Colored Particles 16Bk | 242,000 | 19,000 | 4,100 | 37,000 |

Subsequently, 1 percent by weight of hydrophobic silica (having a number average primary particle diameter of 12 nm and a degree of hydrophobicity of 68) and hydrophobic titanium oxide (having a number average primary particle diameter of 20 nm and a degree of hydrophobicity of 63) were added to each of said Colored Particles Group 1 "Colored Particles 1Bk/1Y/1M/1C" through Colored Particle Group 10 "Colored Particles 10Bk/10Y/10M/10C", "Colored Particles 11Bk" through "Colored Particles 16BK", and each mixture was blended employing a Henschel mixer to obtain a toner. These toners were designated as Toner Group 1 "Toner 1Bk/1Y/1M/1C" through "Toner 10Bk/10Y/10M/10C", "Toner 11Bk" through "Toner 16Bk".

Incidentally, regarding physical properties such as shape, particle diameter, and the like, both colored particles and toners showed no differences.

A silicone resin-coated ferrite carrier, having a volume average diameter of 60 $\mu$m, was mixed with each of said toners, and developers having a toner concentration of 6 percent were prepared. These toners were designated as Developer Group 1 "Developer 1Bk/1Y/1M/1C" through Developer Group 10 "Developer 10Bk/10Y/10M/10C", "Developer 11" through "Developer 16", corresponding to toners.

Herein, employing each of the prepared developers, imaging evaluation was carried out utilizing a Digital Color Printer, Konica 3015, having the same constitution as shown in FIG. 10 except that the constitution of the fixing unit was modified as explained below.

Figure 11:
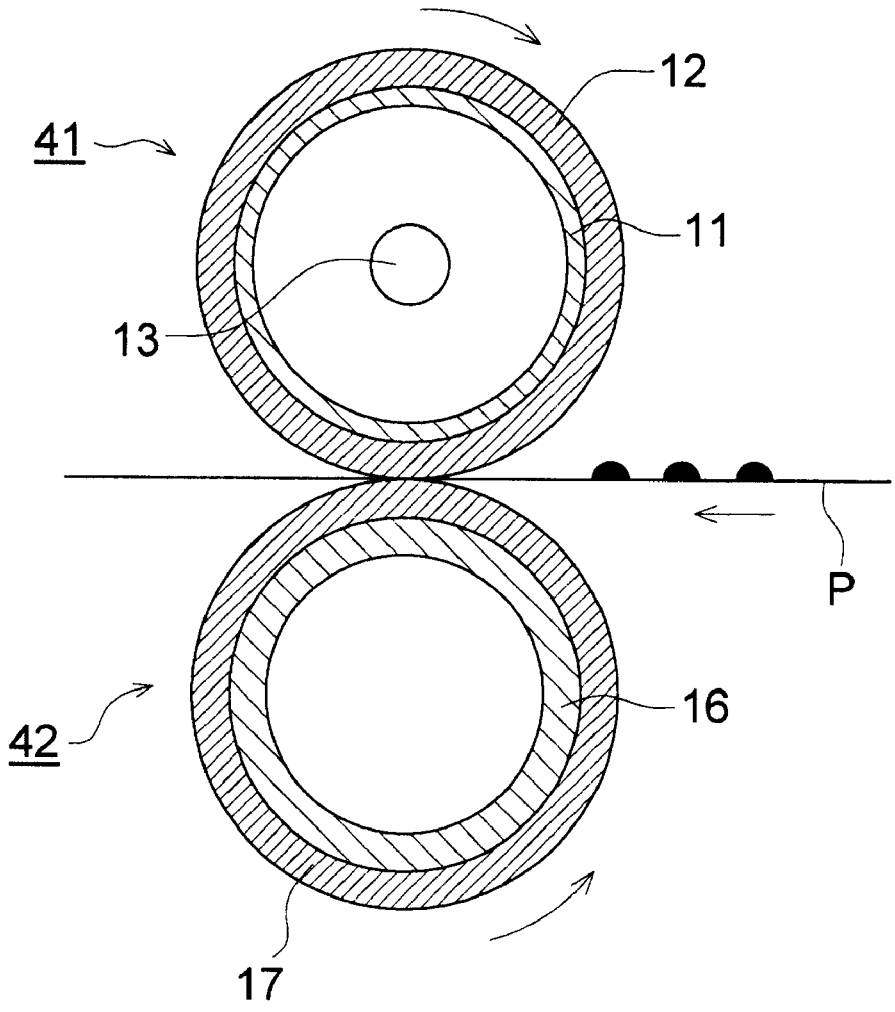
FIG. 11 is a schematic view of the heat-fixing unit according to the present invention.

Employed as the fixing unit was a heating fixing unit employing a pressure contact system as shown in FIG. 11. The specific constitution is as follows.

Said fixing unit comprises as a heating roller 10 (an upper roller) a 1.0 mm thick cylindrical aluminum alloy pipe 11 having an inner diameter of 40 mm and a total length of 310 mm, which comprises PFA (a tetrafluoroethyleneperfluoroalkyl vinyl ether copolymer) covered layer 12 (having a thickness of 120 $\mu$m) on its surface and also comprises in its interior heater 13, and pressure applying roller 15 (a lower roller) comprised of an iron pipe 16, having an inner diameter of 40 mm and a wall thickness of 2.0 mm, which comprises sponge silicone rubber 17 (having an Asker C hardness of 48 and a thickness of 2 mm) on its surface. The nip width was set at 5.8 mm. Said fixing unit was then employed, and the linear speed for printing was set at 250 mm/second.

Employed as the cleaning mechanism of said cleaning unit was a supply system utilizing a web system, which was impregnated with polydipenylsilicone (having a viscosity of 10 Pa·s at 20° C.), was employed.

The fixing temperature was controlled utilizing the surface temperature of said upper roller, said temperature being set at 175° C. Incidentally, the coated amount of silicone oil was set to be at 0.6 mg/A4.

Evaluation of Characteristics

An A4 size monochromatic halftone image (having a relative reflection density of 1.0 when the density of a sheet of paper was "0") was printed utilizing each of Y/M/C/Bk, and subsequently, the fixing ratio was determined. Said fixing ratio, as described herein, was obtained as follows: a fixed image was rubbed with a 1 kg weight wrapped with bleached cotton cloth, and the ratio of differences in density of the image, before and after rubbing, was obtained as a percentage, using the formula below.

Fixing ratio (in percent)={(image density after rubbing/(image density before rubbing))×100

Incidentally, the surface temperature of the heating roller was set at 175° C., determined at the center position.

Further, a full color image, having a pixel ratio of 50 percent, was printed onto 1,000 sheets at a fixing temperature of 175° C. in a tightly closed room measuring a 5×5 m area and a 2 m height, and the presence and absence of objectionable odors was inspected utilizing a sensory evaluation. The presence and absence of said objectionable odors was determined employing 10 inspectors, and the number of inspectors who claimed to notice said objectionable odors was noted.

TABLE 5

| | Developer (Group) No. | Fixing Ratio (in %) | Number of Inspectors Who Claimed to Notice Objectionable Odors |
|---|---|---|---|
| Example 1 | Developer Group 1 | 93 | none |
| Example 2 | Developer Group 2 | 93 | none |
| Example 3 | Developer Group 3 | 91 | none |
| Example 4 | Developer Group 4 | 92 | none |
| Example 5 | Developer Group 5 | 96 | none |
| Example 6 | Developer Group 6 | 96 | none |
| Example 7 | Developer Group 7 | 97 | none |
| Example 8 | Developer Group 8 | 92 | none |
| Example 9 | Developer Group 9 | 93 | none |

TABLE 5-continued

| | Developer (Group) No. | Fixing Ratio (in %) | Number of Inspectors Who Claimed to Notice Objectionable Odors |
|---|---|---|---|
| Example 10 | Developer 11 | 93 | none |
| Example 11 | Developer 12 | 89 | none |
| Example 12 | Developer 13 | 91 | none |
| Example 13 | Developer 14 | 96 | none |
| Example 14 | Developer 15 | 93 | none |
| Comparative Example 1 | Developer Group 10 | 83 | 8 |
| Comparative Example 2 | Developer 16 | 80 | 7 |

In the Examples in the scope of the present invention, no inspector claimed to notice objectionable odors and thus good results were obtained. Further, the fixing ratio did not result in any problem.

Employing each of the prepared developers Examples 1 to 14 and Comparative Examples 1 and 2, imaging evaluation was carried out utilizing a Digital Color Printer, Konica 3015, by two pages intermittent copying (pixcel ratio is 50% for full color image, and 5% for monochrome image) in a low temperature and low humidity circumstances (10° C., 20%RH). Fixing temperature was set at 175° C., and the coated amount of silicone oil was set to be at 0.2 mg/A4. At the initial stage and after 50,000 sheets copying, solid white and black patch image was developed, stain caused by fixing, image density and fog dennsity was measured. The result is summarized in Table 6. The image density shows an absolute reflective density, and the fog is a relative value taking the paper density being 0.

TABLE 6

| | | Stain by Fixing | | Image density | | Fog density | |
|---|---|---|---|---|---|---|---|
| Example | Developer (Group) No. | Initial | After 50,000 | Initial | After 50,000 | Initial | After 50,000 |
| Example 15 | Developer Group 1 | None | None | 1.40 | 1.37 | 0.001 | 0.004 |
| Example 16 | Developer Group 2 | None | None | 1.40 | 1.35 | 0.001 | 0.003 |
| Example 17 | Developer Group 3 | None | None | 1.40 | 1.35 | 0.001 | 0.004 |
| Example 18 | Developer Group 4 | None | None | 1.40 | 1.37 | 0.001 | 0.003 |
| Example 19 | Developer Group 5 | None | None | 1.40 | 1.40 | 0.001 | 0.001 |
| Example 20 | Developer Group 6 | None | None | 1.40 | 1.40 | 0.001 | 0.001 |
| Example 21 | Developer Group 7 | None | None | 1.40 | 1.40 | 0.001 | 0.001 |
| Example 22 | Developer Group 8 | None | None | 1.41 | 1.40 | 0.001 | 0.001 |
| Example 23 | Developer Group 9 | None | None | 1.40 | 1.40 | 0.001 | 0.001 |
| Example 24 | Developer 11 | None | None | 1.40 | 1.37 | 0.001 | 0.003 |
| Example 25 | Developer 12 | None | None | 1.40 | 1.38 | 0.001 | 0.003 |
| Example 26 | Developer 13 | None | None | 1.40 | 1.37 | 0.001 | 0.003 |
| Example 27 | Developer 14 | None | None | 1.40 | 1.39 | 0.001 | 0.001 |
| Example 28 | Developer 15 | None | None | 1.40 | 1.39 | 0.001 | 0.001 |
| Comparative Example 3 | Developer Group 10 | None | Slightly Found | 1.40 | 1.32 | 0.001 | 0.011 |
| Comparative Example 4 | Developer 16 | None | Found | 1.40 | 1.31 | 0.001 | 0.014 |

Based on the present invention, it is possible to provide an electrostatic latent image developing toner, having a small particle diameter, which minimizes the generation of objectionable odors during fixing, and exhibits excellent fixability without resulting in objectionable odor problems, and an image forming method employing the same.

What is claimed is:

1. A toner for developing electrostatic latent image comprising particles containing a resin and a colorant wherein the particles have a volume average particle diameter of from 3 to 8 $\mu$m, the particles have a shape coefficient average value from 0.930 to 0.989, and the resin is obtained by emulsion polymerization, mini-emulsion polymerization or suspension polymerization employing a compound selected from the group consisting of thioglycerin and a compound represented by Formula (1), $$HS—R_1—COOR_2 \quad (1)$$

wherein $R_1$ is an aliphatic group having carbon atoms of from 1 to 10, which may have a substituent, and $R_2$ is an aliphatic group having carbon atoms of from 2 to 15, which may have a substituent.

2. The toner of claim 1, wherein the resin is obtained by emulsion polymerization or mini-emulsion polymerization.

3. The toner of claim 1, wherein the resin is obtained by suspension polymerization.

4. The toner of claim 1, wherein the compound is thioglycerin.

5. The toner of claim 1, wherein the compound is a compound represented by Formula (1).

6. The toner of claim 5, wherein the compound is thioglycolic acid ester compound or 3-mercaptopropionic acid ester compound.

7. The toner of claim 6, wherein the compound is thioglycolic acid ester compound.

8. The toner of claim 7, wherein the compound is ethyl thioglycolate, butyl thioglycolate, t-butyl thioglycolate, 2-ethylhexyl thioglycolate, octyl thioglycolate, isooctyl thioglycolate, decyl thioglycolate, dodecyl thioglycolate, thioglycolic acid ester of ethylene glycol, thioglycolic acid ester of neopentylglycol, thioglycolic acid ester of trimethylolpropane, thioglycolic acid ester of pentaerythritol, or thioglycolic acid ester of sorbitol.

9. The toner of claim 6, wherein the compound is 3-mercaptopropionic acid ester compound.

10. The toner of claim 9, wherein the compound is ethyl 3-mercaptopropionate, 2-ethlhexyl 3-mercaptopropionate, octyl 3-mercaptopropionate, decyl 3-mercaptopropionate, dodecyl 3-mercaptopropionate, pentaerythritoltetrakis ester, 3-mercaptoprpionic acid ester of ethylene glycol, 3-mercaptoprpionic acid ester of neopentyl glycol, 3-mercaptoprpionic acid ester of trimethylolpropane, 3-mercaptoprpionic acid ester of pentaerythritol, and 3-mercaptoprpionic acid ester of sorbitol.

11. The toner of claim 1, wherein amount of the compound is 0.01 to 5 percent by weight with respect the total monomers employed for the synthesis of the resin.

12. The toner of claim 1, wherein the particles further comprise a releasing agent.

13. The toner of claim 12, wherein the releasing agent is an ester wax represented by Formula (2), $$R_3—(OCO—R_4)_n \quad (2)$$

wherein n represents an integer of 1 to 4, $R_3$ and $R_4$ represent a hydrocarbon group which may have a substituent, $R_3$ having from 1 to 40 carbon atoms, $R_4$ having from 1 to 40 carbon atoms.

14. The toner of claim 1, wherein the resin is comprised of a high molecular weight component having a peak or shoulder in a molecular weight range of from 100,000 to 1,000,000 and a low molecular weight component having a peak or shoulder in a molecular weight range of from 1,000 to 20,000.

15. The toner of claim 6, wherein amount of the compound is 0.01 to 5 percent by weight with respect the total monomers employed for the synthesis of the resin.

16. The toner of claim 15, wherein the particles further comprise a releasing agent.

17. The toner of claim 16, wherein the resin is obtained by emulsion polymerization or mini-emulsion polymerization.

18. The toner of claim 1, wherein the particles have a CV value of less than 20%.

19. The toner of claim 18, wherein the particles have a CV value of less than 10%.

* * * * *